US007735841B1

(12) United States Patent
Longino

(10) Patent No.: US 7,735,841 B1
(45) Date of Patent: Jun. 15, 2010

(54) INDEPENDENT SUSPENSION SYSTEM FOR IN-LINE SKATES

(76) Inventor: Robert Keith Longino, 4805 Mendota Ave., Los Angeles, CA (US) 90042

( * ) Notice: Subject to any disclaimer, the term of this patent is extended or adjusted under 35 U.S.C. 154(b) by 386 days.

(21) Appl. No.: 11/985,473

(22) Filed: Nov. 15, 2007

Related U.S. Application Data

(60) Provisional application No. 60/859,563, filed on Nov. 16, 2006.

(51) Int. Cl.
*A63C 17/04* (2006.01)

(52) U.S. Cl. ..... 280/11.28; 280/11.19; 280/11.225

(58) Field of Classification Search ..... 280/11.19, 280/11.221, 11.225, 11.27, 11.28
See application file for complete search history.

(56) References Cited

U.S. PATENT DOCUMENTS 5,582,418 A * 12/1996 Closser ..... 280/11.225
6,454,280 B1 9/2002 Longino
6,478,313 B1 * 11/2002 Gray ..... 280/11.223
6,644,673 B2 11/2003 Longino
7,048,281 B2 5/2006 Longino
2001/0006282 A1 * 7/2001 Green et al. ..... 280/11.225

* cited by examiner

*Primary Examiner*—Frank B Vanaman
*Assistant Examiner*—John D Walters
(74) *Attorney, Agent, or Firm*—Peter Ganjian

(57) ABSTRACT

A polyurethane biasing mechanism, comprising a first surface contact area with a first mass having a durometer that provides a first resistance and a first rate of resistance responsive to application of forces. The biasing mechanism having a second surface contact area with a second mass having the same durometer that provides a second resistance and a second rate of resistance responsive to the forces. The first resistance and the first rate of resistance are different from the second resistance and second rate of resistance, a combination of which provides a rate of resistance that commensurately varies and is correspondingly responsive in relation to varying forces.

2 Claims, 24 Drawing Sheets

INDEPENDENT SUSPENSION SYSTEM FOR IN-LINE SKATES

CROSS-REFERENCE TO RELATED APPLICATIONS

This Application claims the benefit of priority of U.S. Utility Provisional Patent Application No. 60/859,563, filed Nov. 16, 2006, the entire disclosure of which is expressly incorporated by reference in its entirety herein.

BACKGROUND OF THE INVENTION (1) Field of the Invention

The present invention relates to in-line skates and, more particularly, to an independent suspension system thereof that uses an elastomer in the form of a synthetic resin spring, a non-limiting example of which is a polyurethane spring.

(2) Description of Related Art

In-line skates are well known, and have essentially replaced regular roller-skates, and are used by speed skaters and ice-hockey players for dry-land activities. In general, in-line skates are used outside on sidewalks and other road surfaces that may be uneven, which can cause stress on the wheels, boots, and other structural elements of the skate as well as discomfort for the skater.

In the past, systems and mechanisms have been developed to improve the suspension system of the in-line skate so that the skate will absorb the shocks caused on the skate by uneven riding surfaces. Reference is made to the following few exemplary U.S. Patent Publications, including U.S. Pat. Nos. 7,048,281; 6,644,673; and 6,454,280, all to Longino, the entire disclosures of all of which patents is expressly incorporated by reference in their entirety herein.

As illustrated in FIG. 1A, prior art conventional suspension systems use a polyurethane spring 100 that has a smooth and even outer surface, and that is captured within a smooth and even cavity 106 of rocker arms 102 and 104, which are compressed into the polyurethane spring 100. As best illustrated in FIGS. 1B to 1G, the prior art polyurethane spring 100 generally includes a through-hole 108, which provides a more flexible spring compared with solid polyurethane springs that are more rigid. As seen in FIGS. 1B to 1D, the through-hole 108 can be of any general shape wherein each shape provides for different degrees of variability for the spring 100. In addition to the regular elasticity of the polyurethane, the through-hole 108 provides space into which polyurethane material can additionally move. The size and dimension of the through-hole 108 can effect the rigidity of the spring 100, and as can be appreciated, the larger the surface area of the through-hole 108, the more variability that is provided by the spring 100.

In prior art springs 100, in order to further adjust their strength or resistance, an adjustment post 110 (FIG. 1E) is placed into the through-hole 108. The post 110 placed within the through-hole 108 reduces the size (volume) of the void space of the through-hole, and hence, reducing the space into which polyurethane material can additionally move and thereby, increasing spring 100 resistance. The size of the adjustment post 110 from the furthest edges formed by the wave-like shape is proximate the size of the through-hole 108 so that the post 110 fits easily into the through-hole 108 while engaging the spring 100 at the sides of the through-hole 108. The adjustment rod 110 is made of a suitably rigid material so that it can contribute to the variability of the spring 100. The adjustment rod 110 must also be flexible so that when the spring 100 flexes within the confines of the hole 108 the integrity of the rod is maintained and that it will return to its original shape when the force is removed from the spring. FIGS. 1F and 1G illustrate the spring 100 with the adjustment post 110 in two different positions thereby changing and varying the rigidity of the spring 100. In FIG. 1F, the post 110 is in the vertical position whereby the spring material is given the greatest area to flex within the hole 108 (least resistance); in FIG. 1G, the post 110 is in the horizontal position whereby the spring material does not have the same ability to deform, or flex within the hole and provides a more rigid spring than that compared to FIG. 1F. In addition, the adjustment rod 110 itself contributes to the rigidity of the spring 100. The adjustment post 110 can be rotated between the vertexes of the hole 108 to vary the strength or resistance of the spring. As the post 110 rotates from a vertical orientation to a horizontal orientation, the strength of the spring is enhanced. As the post is moved to the horizontal, the resistance within the space is increased against the pressing of the rocker arms, thereby making a more rigid spring.

As described above, regrettably, the prior art suspension systems are complicated, and require user meddling with the suspension system for adjustment of the spring resistance for specific users. Further, having the holes within springs also means that the springs would not function properly with heavier weight individuals, and hence, the need for the post. Therefore, the prior art suspension systems must be particularized and specifically made and adjusted for different individuals, which makes the use and manufacturing of the entire in-line skates too complicated and costly, with variations in the quality of the end product.

In addition, the prior art suspension systems have a limited range of resistance for different user weights, and have an undesired responsiveness in terms of their rate of resistance in relation to shifting of user weight during the ride of the in-line skates (for example, during quick, sharp turns when large amounts of force are applied to the spring). Further, the prior art suspension systems that use the adjustment rod are prone to breakage. In particular, when the adjustment rod is turned horizontally, it can only contact two of the vertexes of the holes while the rest of the vertices remain free. This creates uneven resistances within the spring hole, which can easily cause cracking and breakage of the spring due to fatigue under very large forces on only two vertexes.

Accordingly, in light of the current state of the art and the drawbacks to current polyurethane springs mentioned above, a need exists for a spring apparatus that would provide a wide range of resistance to accommodate a smooth ride against the application of different forces and, more particularly, that would provide a rate of resistance that would commensurately vary and be correspondingly responsive in relation to shifting of user weights during the ride of the in-line skates, without requiring any adjustments. In addition, a need exists for such an apparatus that would be simple and not require user meddling with the suspension system for adjustment of resistance and rate of resistance of the spring.

BRIEF SUMMARY OF THE INVENTION

One aspect of the present invention provides a polyurethane biasing mechanism (e.g., a polyurethane spring), comprising:

a first surface contact area with a first mass having a durometer that provides a first resistance and a first rate of resistance responsive to application of forces;

a second surface contact area with a second mass having the same durometer that provides a second resistance and a second rate of resistance responsive to the forces;

with the first resistance and the first rate of resistance different from the second resistance and second rate of resistance, a combination of which provides a rate of resistance that commensurately varies and is correspondingly responsive in relation to varying forces.

Another aspect of the present invention provides a method for varying a resistive response and resistive rate of response of a polyurethane biasing mechanism, comprising:

increasing a contact surface area and lowering a mass of the polyurethane spring by providing:

two mass regions and two surface contact areas, including:

a first surface contact area with a first mass having a durometer that provides a first resistance and a first rate of resistance responsive to application of forces;

a second surface contact area with a second mass having the same durometer that provides a second resistance and a second rate of resistance responsive to the forces;

with the first resistance and the first rate of resistance different from the second resistance and second rate of resistance, a combination of which provides a rate of resistance that commensurately varies and is correspondingly responsive in relation to varying forces.

Yet another aspect of the present invention provides a spring, comprising:

a polyurethane material having an axial length L, a width W, and a thickness T;

a top surface that includes a slightly concaved section that is extended longitudinally, along the axial length L of the spring;

the slightly concaved section includes lateral edge depressions extending longitudinally, along the axial length L of the spring;

two lateral side surfaces, and extending longitudinally along the axial length L of the spring;

the lateral side surfaces includes a plurality of notches that are formed into the lateral side surfaces of the spring;

the notches are aligned laterally along the axial length L of the spring, forming an alternating notch and protuberance;

each notch of the plurality of notches is comprised of a substantially flat base, with the curved protuberances forming two side walls of each notch;

a bottom surface.

A further aspect of the present invention provides a set of rocker arms, comprising:

a first rocker arm having a first axial length L, a first axial width W, and a first height H;

a second rocker arm having a second axial length L, a second axial width W, and a second height H;

the first rocker arm having a first skate wheel connection;

the second rocker arm a second skate wheel connection;

a pivoting axle connection, the pivoting axle connection pivotally coupling the first rocker arm and the second rocker arm;

a spring housing:

the pivoting axle connection forming a bottom of the spring housing;

the spring housing further including two lateral side walls that are longitudinally extended along the axial width W of the set of rocker arms, with each lateral side wall, comprising:

a plurality of flanges, the flanges are aligned laterally along the axial width W of the forming an alternating protuberance and depression; and a top.

Still a further optional aspect of the present invention provides a set of rocker arms, wherein:

the first axial length L, the first axial width W, and the first height H are equal to the second axial length L, the second axial width W, and the second height H.

Another aspect of the present invention provides a suspension system, comprising:

a first rocker arm having a first skate wheel connection at first distal end;

a second rocker arm having a second skate wheel connection at a second distal end;

a spring housing;

a pivoting axle connection, the pivoting axle connection pivotally connecting the first rocker arm at a first proximal end and the second rocker arm at a second proximal end, and forming a bottom of the spring housing;

the spring housing further including two lateral side walls at the first and second proximal end of the respective first and second rocker arms;

the lateral side walls include a plurality of flanges that are-aligned laterally along the lateral side walls; and a spring comprised of polyurethane, including:

a top surface that includes two lateral edge depressions that securely abut the lip;

two lateral side surfaces that include a plurality of notches that are aligned laterally, and abut the plurality of flanges; and a bottom surface that abuts the pivoting axle connection;

the spring contacting the first rocker arm and the second rocker arm and biasing the rocker arms so that the rocker arms counter-rotate about the pivoting axle.

Another aspect of the present invention provides an in-line skate wheel suspension product, the product comprising:

a tracking system that is comprised of a base-support comprised of a fore plate and an aft plate coupled with a sole of a boot;

side panels extending downward from the base-support;

the side panels are spaced apart, which enable positioning a skate wheel between the side panels;

a first rocker arm disposed between the side panels;

the first rocker arm having a first skate wheel rotatably connected to the first rocker arm at a first skate wheel connection;

a second rocker arm disposed between the side panels;

the second rocker arm having a second skate wheel rotatably connected to the second rocker arm at a second skate wheel connection;

a pivoting axle, the pivoting axle pivotally connecting the first rocker arm and the second rocker arm to at least one of the tracking system side panels;

a spring, the spring positioned above the pivoting axle;

the spring positioned between the first rocker arm and the second rocker arm;

the spring having a plurality of notches, positioned laterally along an axial length of the spring, with each notch biased against a corresponding protrusion on the rocker arm;

the spring contacting the first rocker arm and the second rocker arm and biasing the rocker arms so that the rocker arms counter-rotate about the pivoting axle;

the spring contacting the first rocker arm at a position radially between the pivoting axle and the first skate wheel connection; and the spring contacting the second rocker arm at a position radially between the pivoting axle and the second skate wheel connection.

These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character (s) present corresponding part(s) throughout.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

Figure 1A:
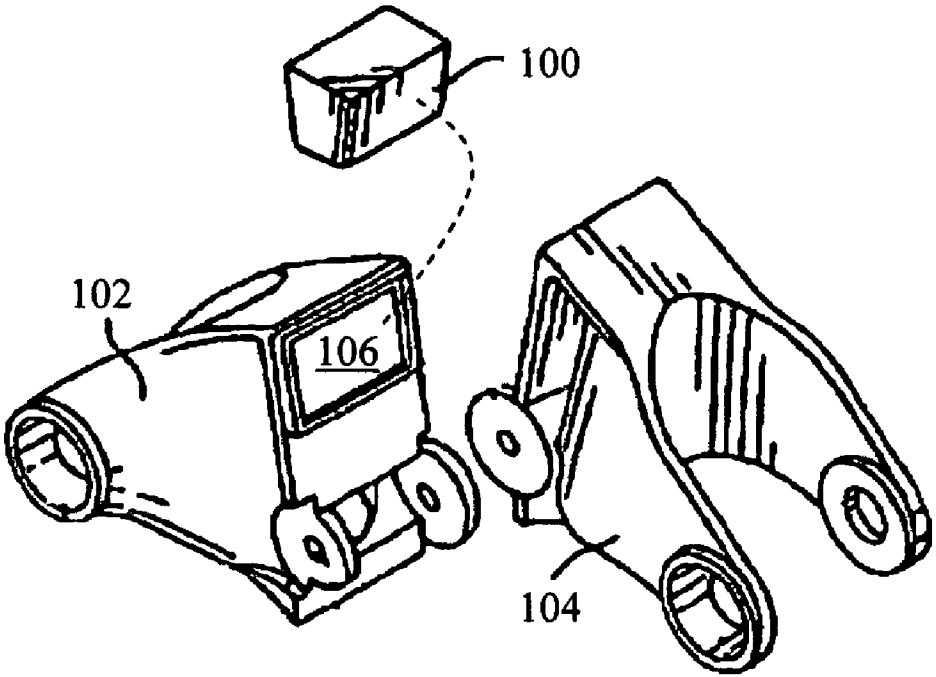
FIG. 1A (PRIOR ART)
FIG. 1A, is an exemplary illustration of a prior art conventional suspension system.
Figure 1D:
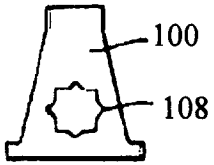
FIG. 1D (PRIOR ART)
FIGS. 1B to 1G, are exemplary illustrations of prior art polyurethane spring mechanisms.
Figure 1E:
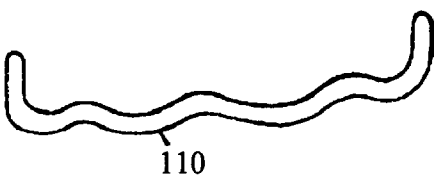
FIG. 1E (PRIOR ART)
Figure 1C:
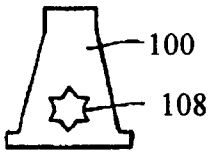
FIG. 1C (PRIOR ART)
Figure 1G:
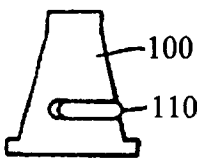
FIG. 1G (PRIOR ART)
Figure 1B:
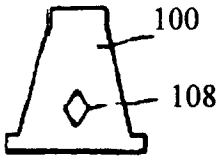
FIG. 1B (PRIOR ART)
Figure 1F:
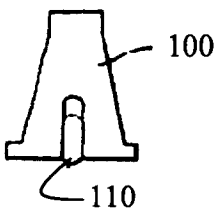
FIG. 1F (PRIOR ART)
Figure 2A:
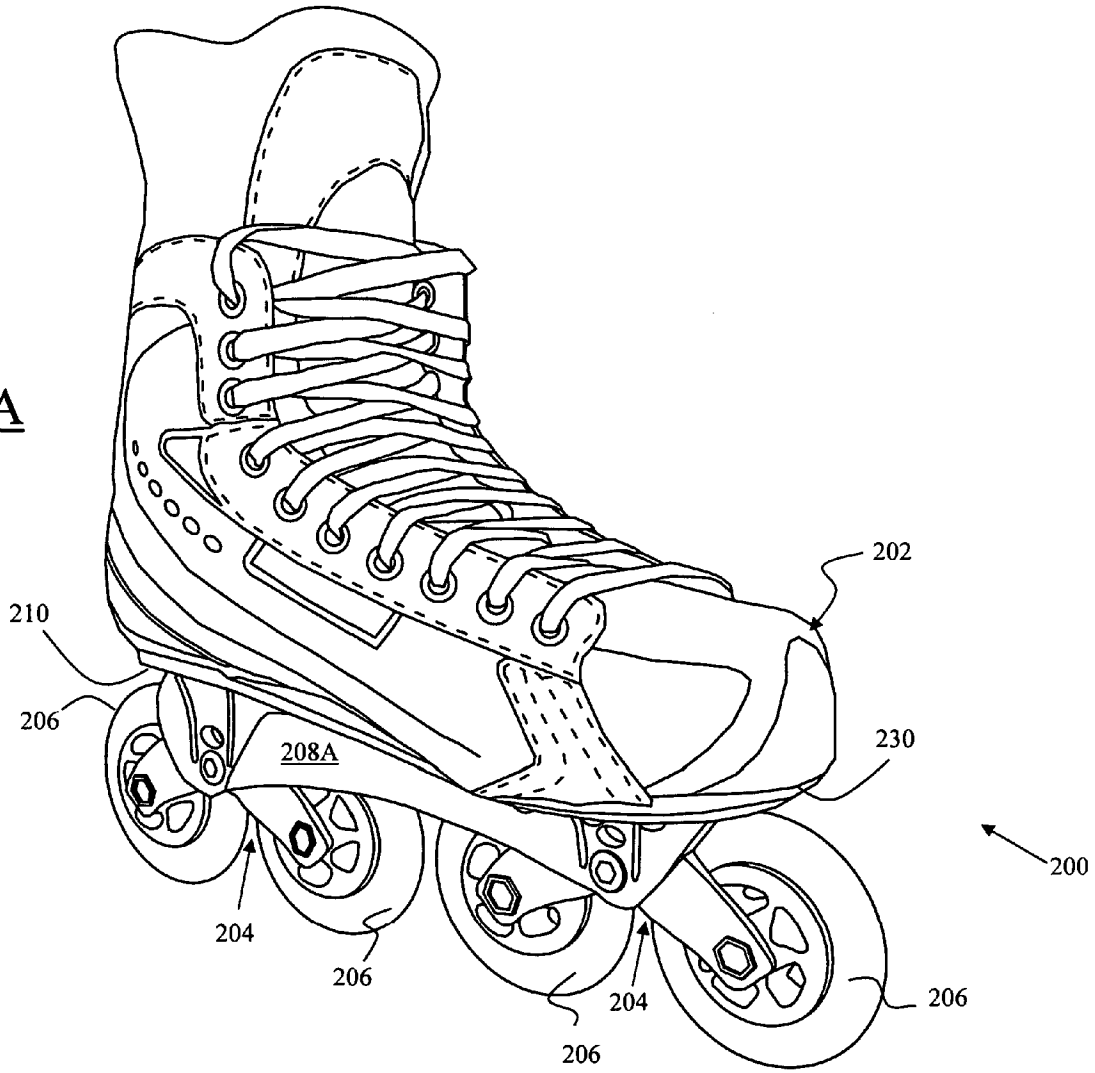
FIG. 2A is an exemplary perspective illustration of an in-line skate in accordance with the present invention.
Figure 2B:
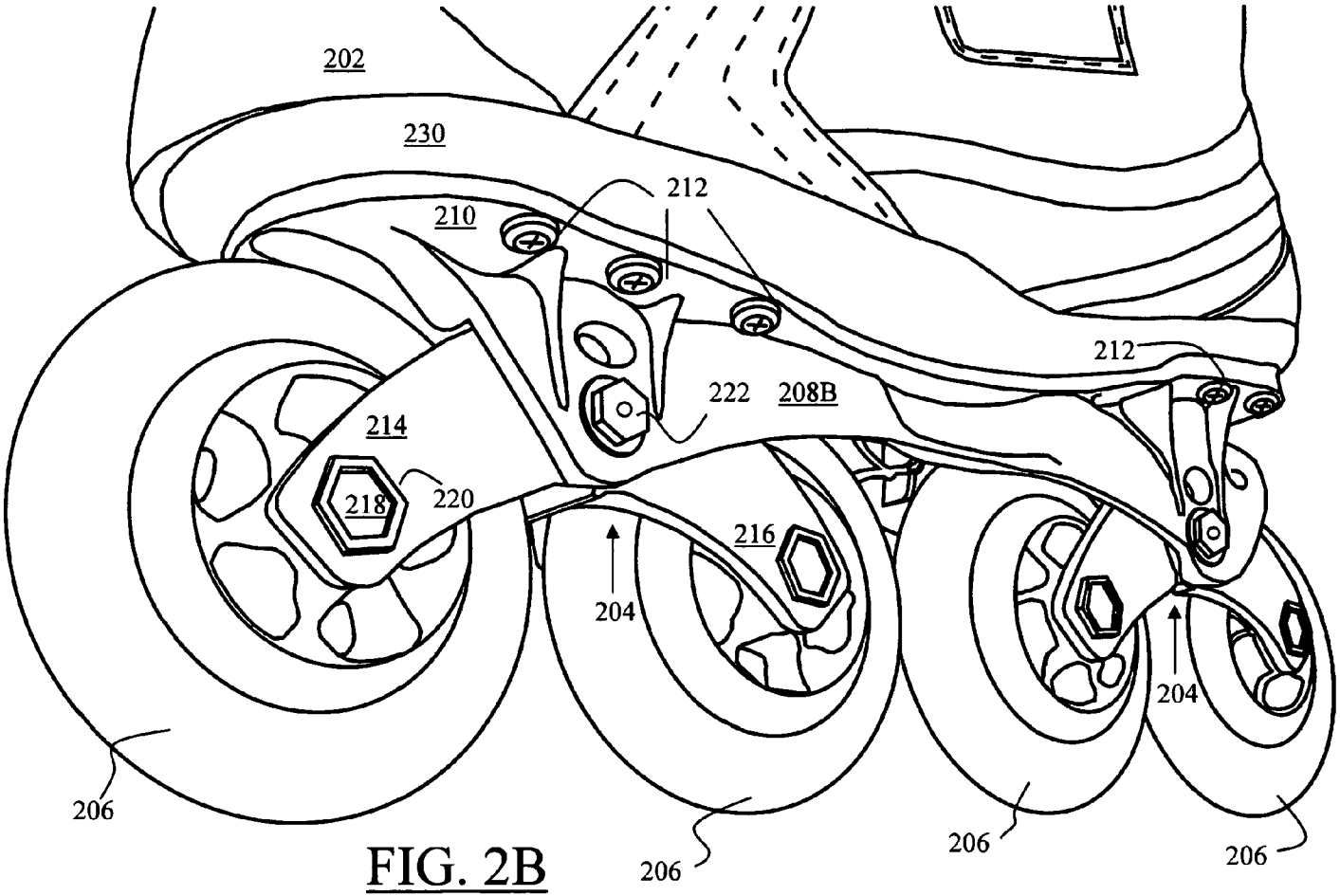
FIG. 2B is an exemplary enlarged perspective illustration of the in-line skate illustrated in FIG. 2A, showing an assembled tracking system in accordance with the present invention.
Figure 2C:
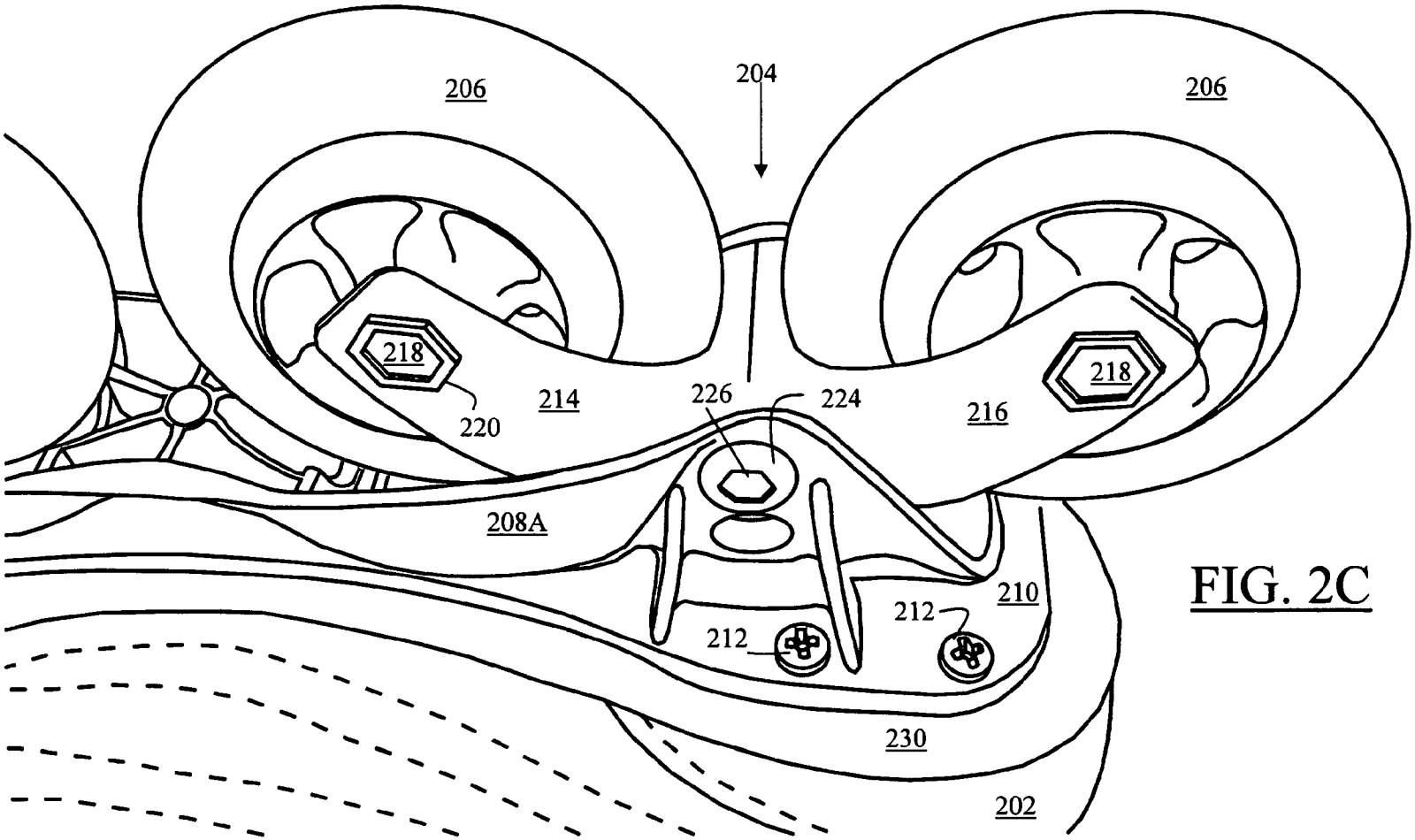
FIG. 2C is an exemplary perspective illustration of the bottom aft-section of the assembled tracking system of FIG. 2A.

FIGS. 2A to 2C illustrate an in-line skate that includes a suspension mechanism made in accordance with the principals of the present invention. FIG. 2A is an exemplary perspective illustration of an in-line skate in accordance with the present invention. FIG. 2B is an exemplary enlarged perspective illustration of the in-line skate illustrated in FIG. 2A, showing an assembled tracking system, and FIG. 2C is an exemplary perspective illustration of the bottom aft-section of the assembled tracking system in accordance with the present invention.

As illustrated in FIGS. 2A to 2C, the in-line skate 200 includes a boot 202 that is configured to hold and support the foot of the wearer. The boot 202 includes a sole 230 with a tracking system 210 attached to it by a set of fasteners, non-limiting examples of which may include a set of screws 212 in the aft-plate 304, the mid-plate 306, and the fore-plate 308 sections (FIG. 3A) of the tracking system 210. The tracking system 210 is made of any suitable material and is preferably made of plastic or aluminum. The tracking system 210 includes a series of wheels 206 rotatably attached to it so that the wheels 206 form a line. The wheels 206 are coupled with the tracking system 210 using the suspension mechanism 204 of the present invention. The suspension mechanism 204 is pivotally coupled with the tracking system 210 at a pivoting axis 310 (FIG. 3D) by an exemplary fastener 222, with the wheels 206 coupled to the distal ends of the suspension mechanisms 204 by exemplary fasteners 218. The suspension mechanism 204 allows the wheels 206 to move individually and independently relative to the boot 202 so that the in-line skate 200 can move smoothly over an uneven surface. Further, the suspension mechanism 204 maintains the wheels 206 in contact with the ground surface longer as the force from the weight of the wearer shifts, which provides increased stability. The suspension mechanism 204 further improves the maneuverability of the skates by enabling turns with shorter radius, wherein only one set of the wheels may be used to complete a turn.

As further illustrated in FIGS. 2A to 2C, fasteners 226 are complementary secured at the other end by a set of exemplary nuts 222, with the head of the fasteners 226 housed in a commensurately configured housings 224 so to prevent the rotation of the fasteners 226 during the movement of the suspension mechanism 204 while riding the skates. The fasteners 218 are also housed in respectively configured housings 220 so to prevent the rotation of the fasteners 218 during the movement of the suspension mechanism 204 while riding the skates.

Figure 3A:
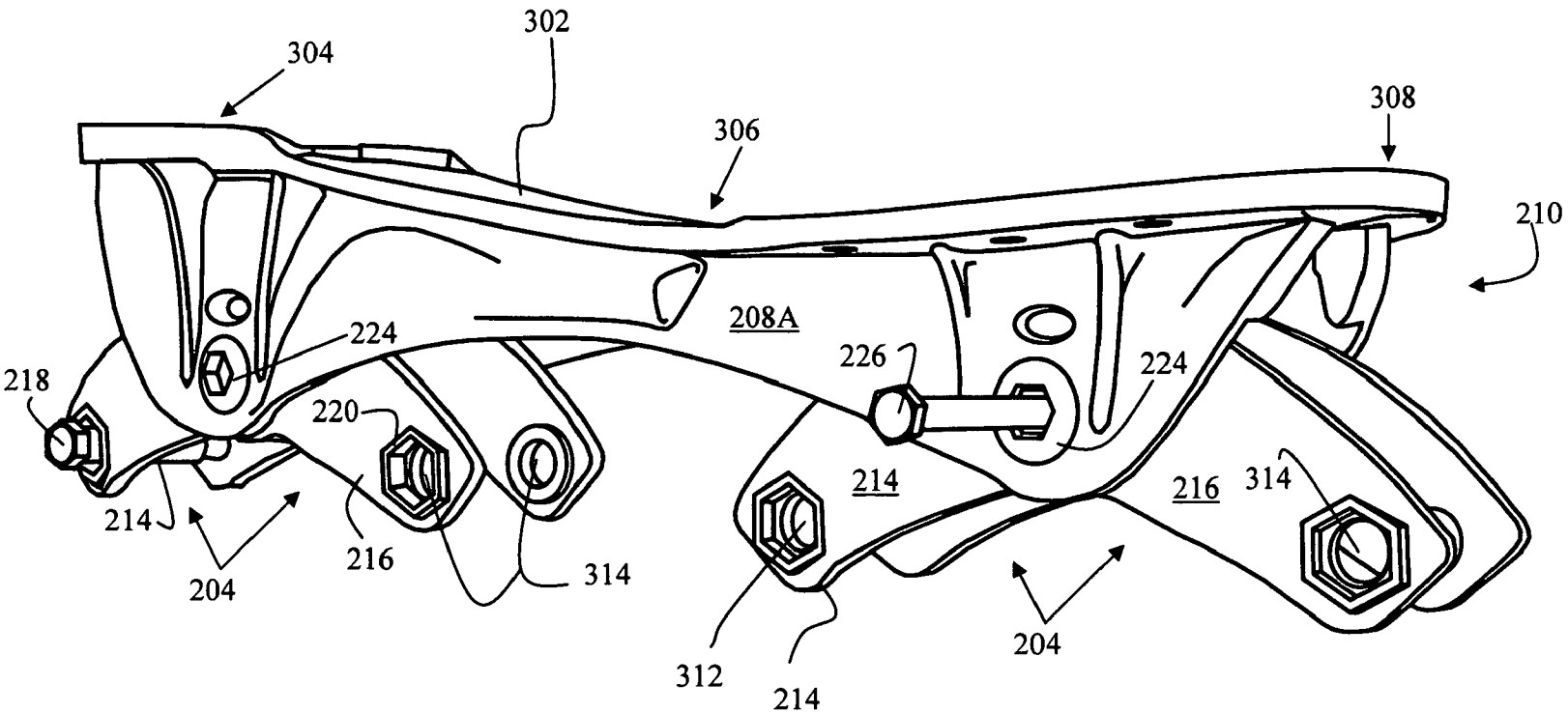
FIG. 3A is an exemplary perspective illustration of a semi-disassembled tracking system that is illustrated in FIG. 2A, showing a first side thereof in accordance with the present invention.
Figure 3B:
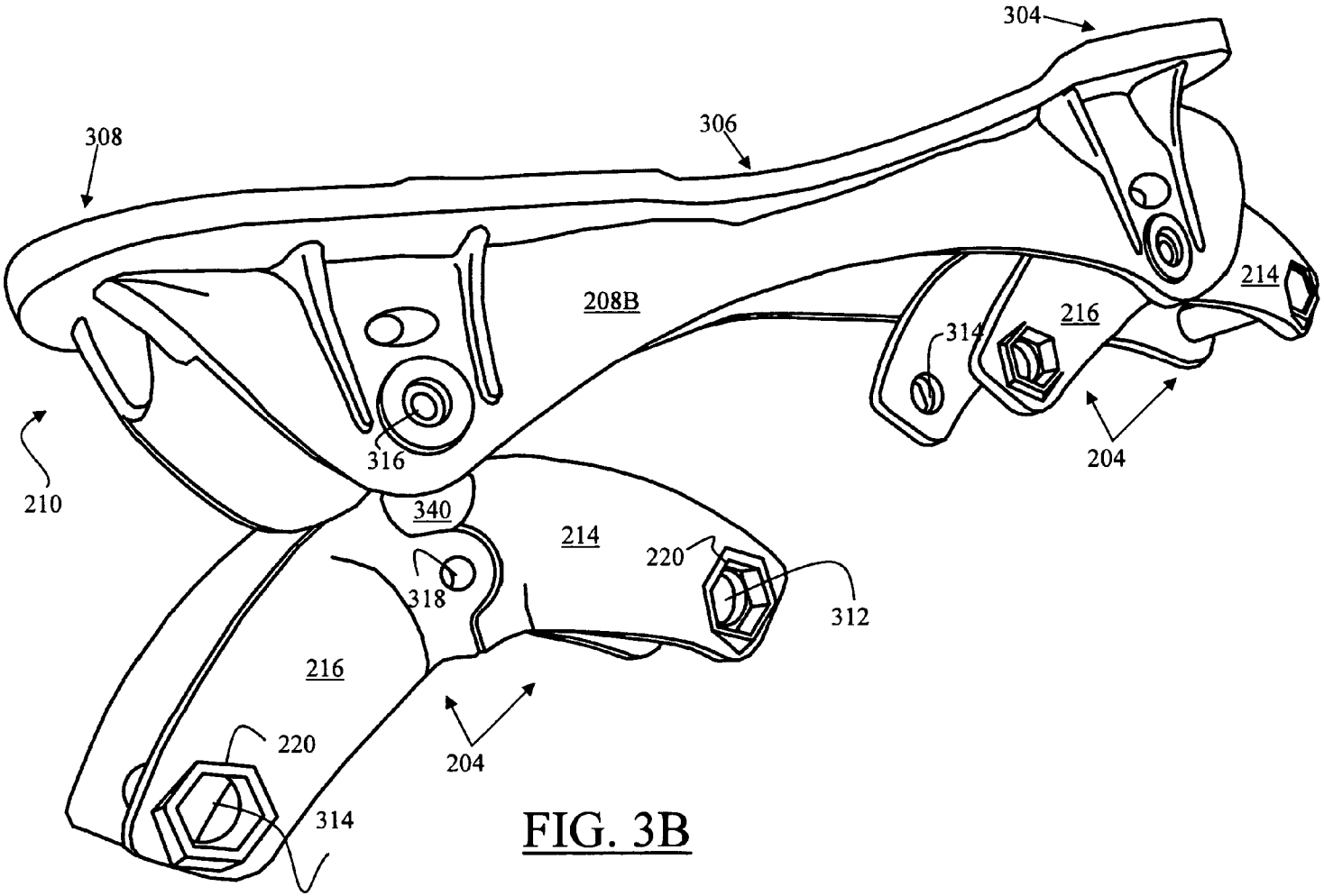
FIG. 3B is an exemplary perspective illustration of the tracking system that is illustrated in FIG. 2A, showing the second side thereof.
Figure 3C:
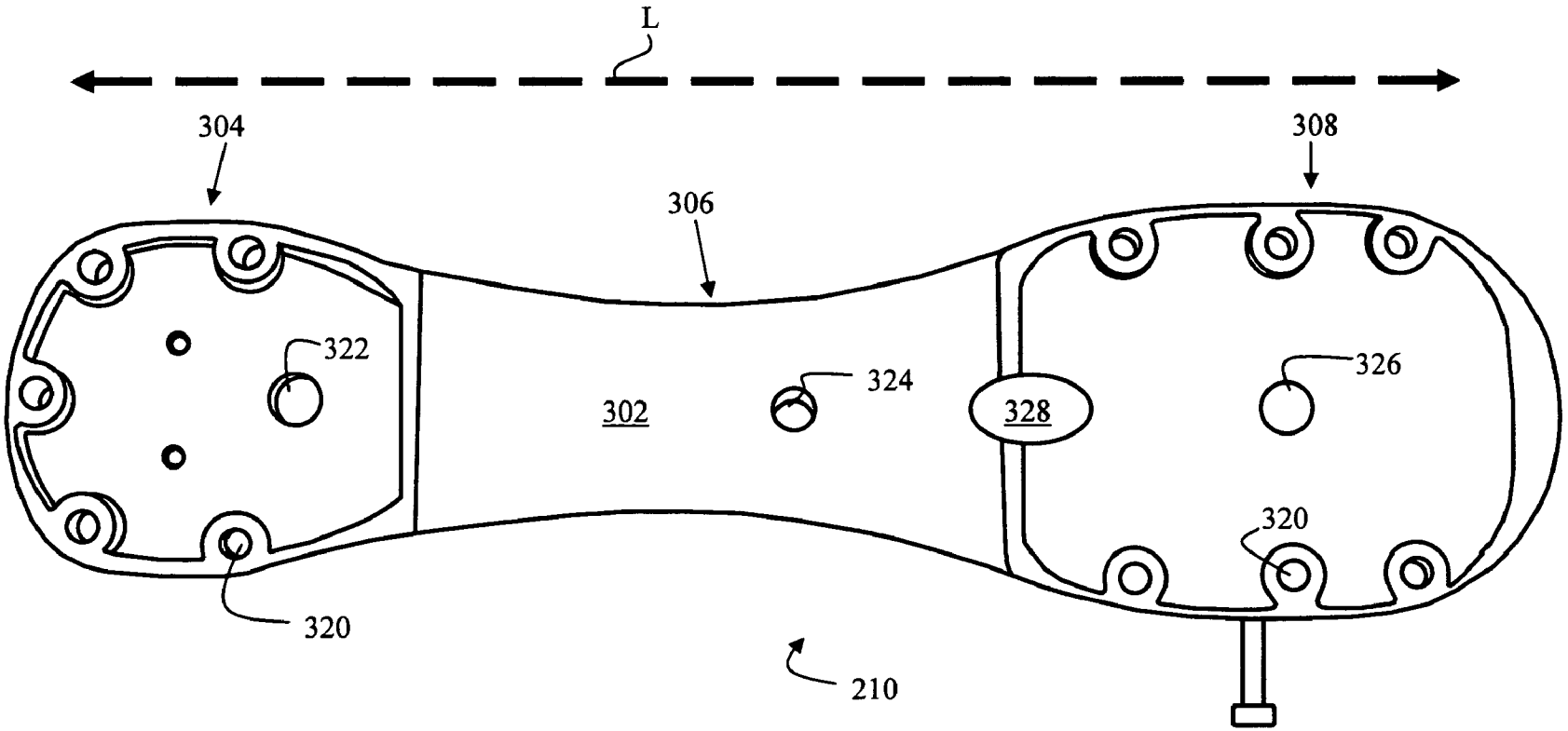
FIG. 3C is an exemplary top perspective view of the tracking system of FIG. 2A.
Figure 3D:
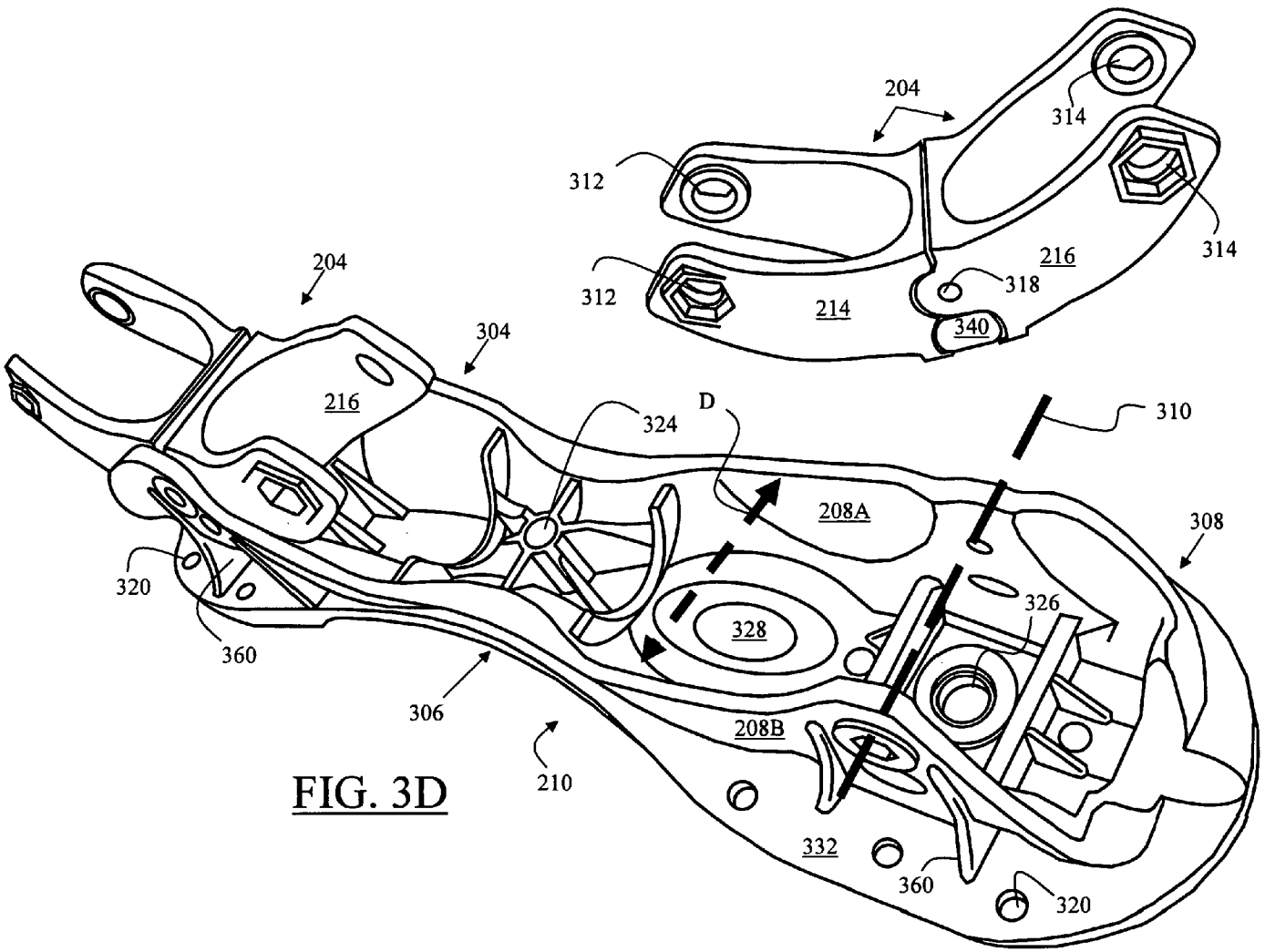
FIG. 3D is an exemplary bottom perspective illustration of the tracking system of FIG. 2A with the fore suspension mechanism removed.
Figure 3E:
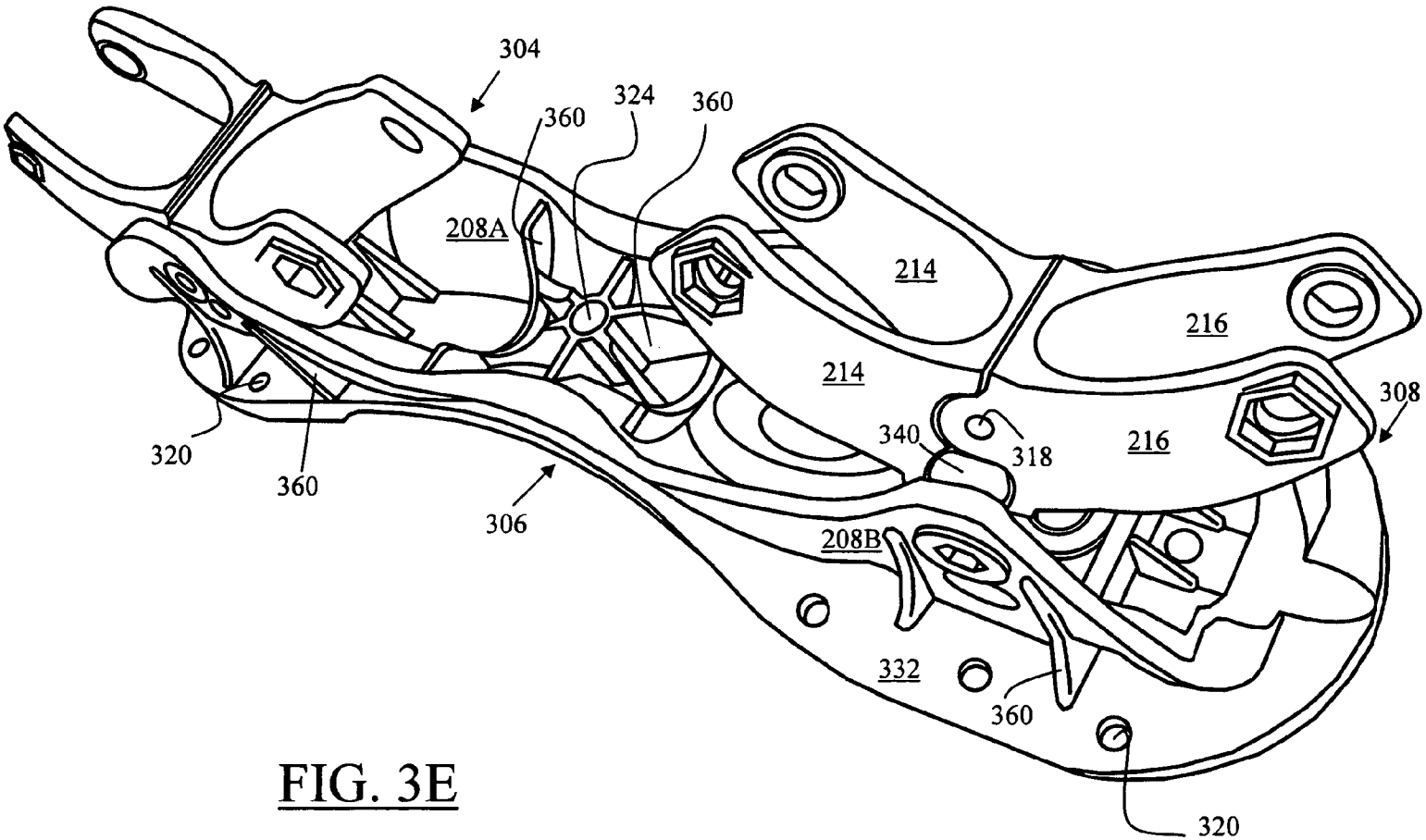
FIG. 3E is an exemplary bottom perspective illustration of the tracking system of FIG. 2A with the fore suspension mechanism semi-assembled.
Figure 3F:
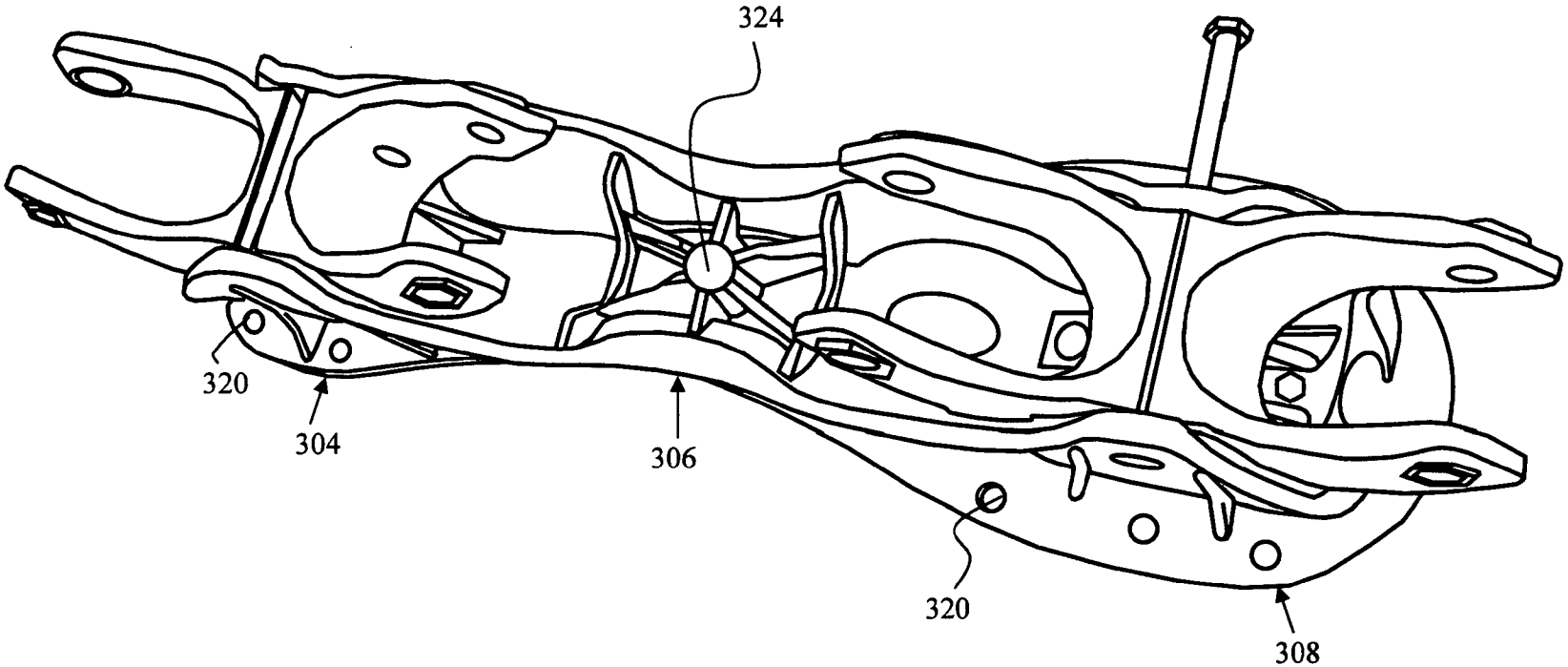
FIG. 3F is an exemplary bottom perspective illustration of the tracking system of FIG. 2A with the fore suspension mechanism being secured thereto by a fastener mechanism.

FIGS. 3A to 3F exemplarily illustrate the tracking system 210 in accordance with the present invention. FIG. 3A is an exemplary perspective illustration of a semi-disassembled tracking system that is illustrated in FIG. 2A, showing a first side thereof; and FIG. 3B is an exemplary perspective illustration of the tracking system that is illustrated in FIG. 2A, showing the second side thereof. FIG. 3C is an exemplary top perspective view of the tracking system of FIG. 2A. FIG. 3D is an exemplary bottom perspective illustration of the tracking system of FIG. 2A with the fore suspension mechanism removed; FIG. 3E is an exemplary bottom perspective illustration of the tracking system of FIG. 2A with the fore suspension mechanism semi-assembled; and FIG. 3F is an exemplary bottom perspective illustration of the tracking system of FIG. 2A with the fore suspension mechanism being secured thereto by a fastener mechanism.

As illustrated in FIGS. 3A to 3F, the tracking system 210 of the present invention is comprised of a base-plate 302. The sole 230 of the boot 202 is coupled to the base plate 302 by a set of fasteners in the aft-plate 304, the mid-plate 306, and the fore-plate 308 sections of the tracking system 210. The tracking system 210 is further comprised of two side panels 208A and 208B that enable the positioning of the suspension mechanisms 204 underneath the base-plate 302. The two side panels 208A and 208B extend substantially, longitudinally along an axial length L (FIG. 3C) of the tacking system 210, and further extend (or protrude) downward from the base-plate 302 to form the sides 208A and 208B, illustrated. The two side panels 208A and 208B are spaced apart laterally at varying distances D (FIG. 3D) along the axial length L of the tracking system 210 to allow positioning of the suspension mechanism 204 and the wheels 206 in between the side panels 208A and 208B. The two side panels 208A and 208B may also be spaced apart laterally at an equal distance along the axial length L of the tracking system.

As best illustrated in FIG. 3C, the base-plate 302 of the tracking system 210 is comprised of the mid-plate section 306 that is laterally narrower than the aft-plate 304 or the fore-plate 308, which reduces the overall mass of the tracking system 210 without loss in overall strength and ride stability. The base-plate 302 is comprised of a set of apertures 320 in both the aft-plate portion 304 and the fore-plate portion 308 for fastening the boot 202 onto the tracking system 210 via the set of exemplary fasteners 212. Further included on the base-plate 302 is a first aperture 322 at the aft-plate portion 304 and a second aperture 326 at the fore-plate portion 308 that function as mounting holes, and are optionally used to further secure the boot 202 with the tracking system 210. The chamber hole 324 at the mid-plate 302 is not an aperture or a through-hole, but is formed as an exemplary cylinder added as part of the bulk structures 360 for added strength. The aperture 328 between the respective mid-plate and fore-plate sections 306 and 308 is created to provide a void space to allow the front middle wheel to move into when the front middle wheel is in its maximum upward position, thereby preventing contact with the bottom side 332 of the base plate 302.

As best illustrated in FIGS. 3D to 3F, the bottom side 332 of the tracking system 210 includes the longitudinally extended two side panels 208A and 208B that are spaced apart laterally at varying lateral distances D (FIG. 3D) along the axial length L of the tracking system 210 to allow positioning of the suspension mechanism 204 and the wheels 206 in between the panels 208A and 208B. The two lateral sides 208A and 208B protrude substantially vertical from the bottom side 332 of the base-plate 302 of the tracking system 210, and are further supported by added bulk structures 360 for added strength. The suspension mechanism 204 is pivotally coupled with the tracking system 210 at a pivoting axis 310 (FIG. 3D) by an exemplary fastener 226, with the wheels 206 coupled to the distal ends of the suspension mechanisms 204 by exemplary fasteners 218.

FIGS. 4A to 4F are exemplary illustrations of the suspension mechanism 204 in accordance with the present invention. As illustrated, the suspension mechanism 204 is comprised of a set of rocker arms 214 and 216, and a biasing mechanism 340. The set of rocker arms includes a first rocker arm 214 having a first skate wheel connection 312 at first distal end 460, and a second rocker arm 216 having a second skate wheel connection 314 at a second distal end 462. The suspension mechanism 204 also includes a biasing mechanism housing 420 (FIG. 4E) for detachably and removably securing the biasing mechanism 340 therein. The suspension mechanism 204 includes a pivoting axis 310 and a pivoting axle connection 318, the pivoting axle connection 318 pivotally connecting the first rocker arm 214 at a first proximal end 464 and the second rocker arm 216 at a second proximal end 466. The pivot axle connection 318 further couples the rocker arms to the tracking system 210, and forms a bottom 500 (FIG. 5A) of the biasing mechanism housing 420.

Figure 4A:
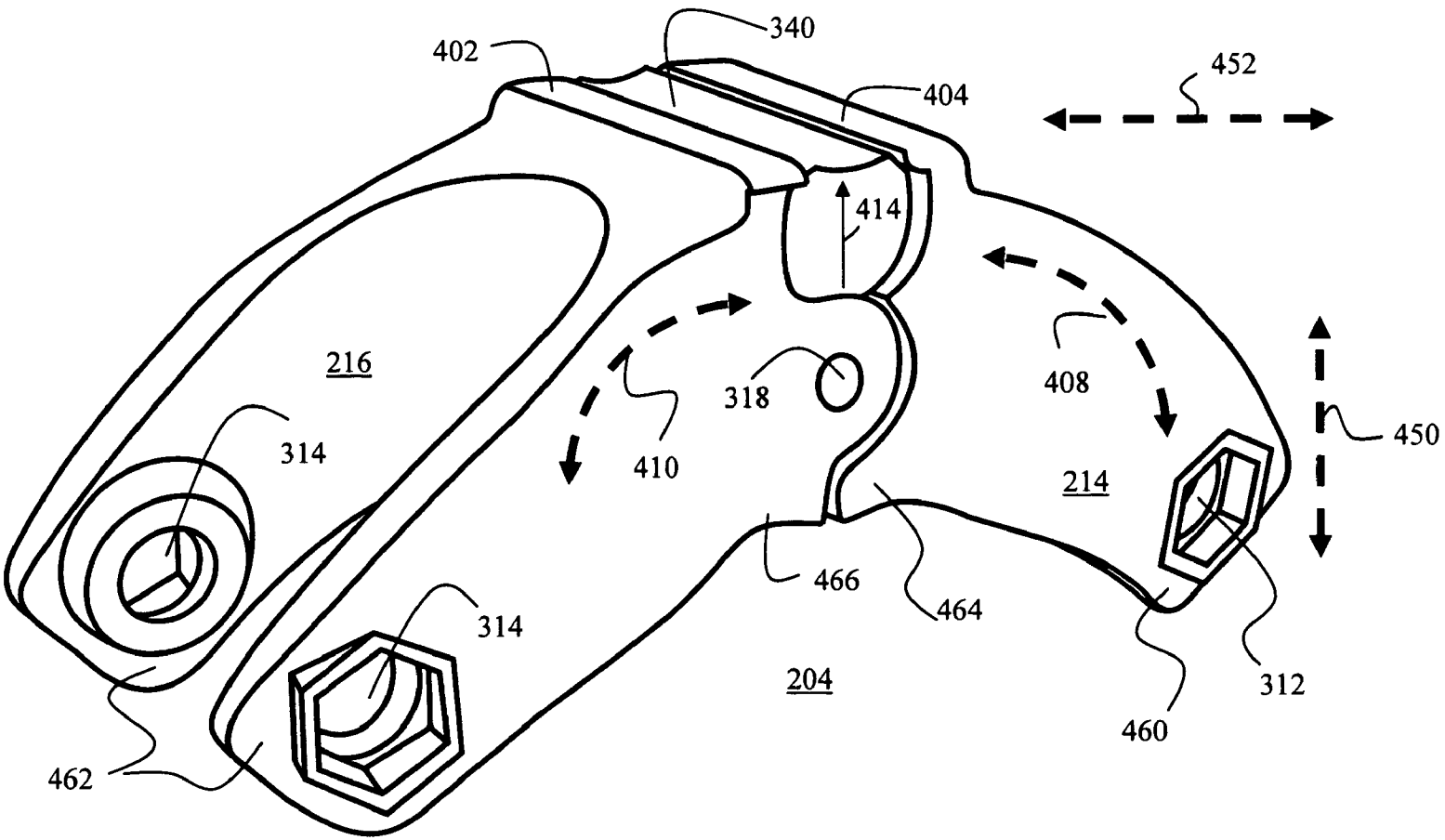
FIG. 4A is an exemplary perspective illustration of the suspension mechanism in accordance with the present invention.
Figure 4B:
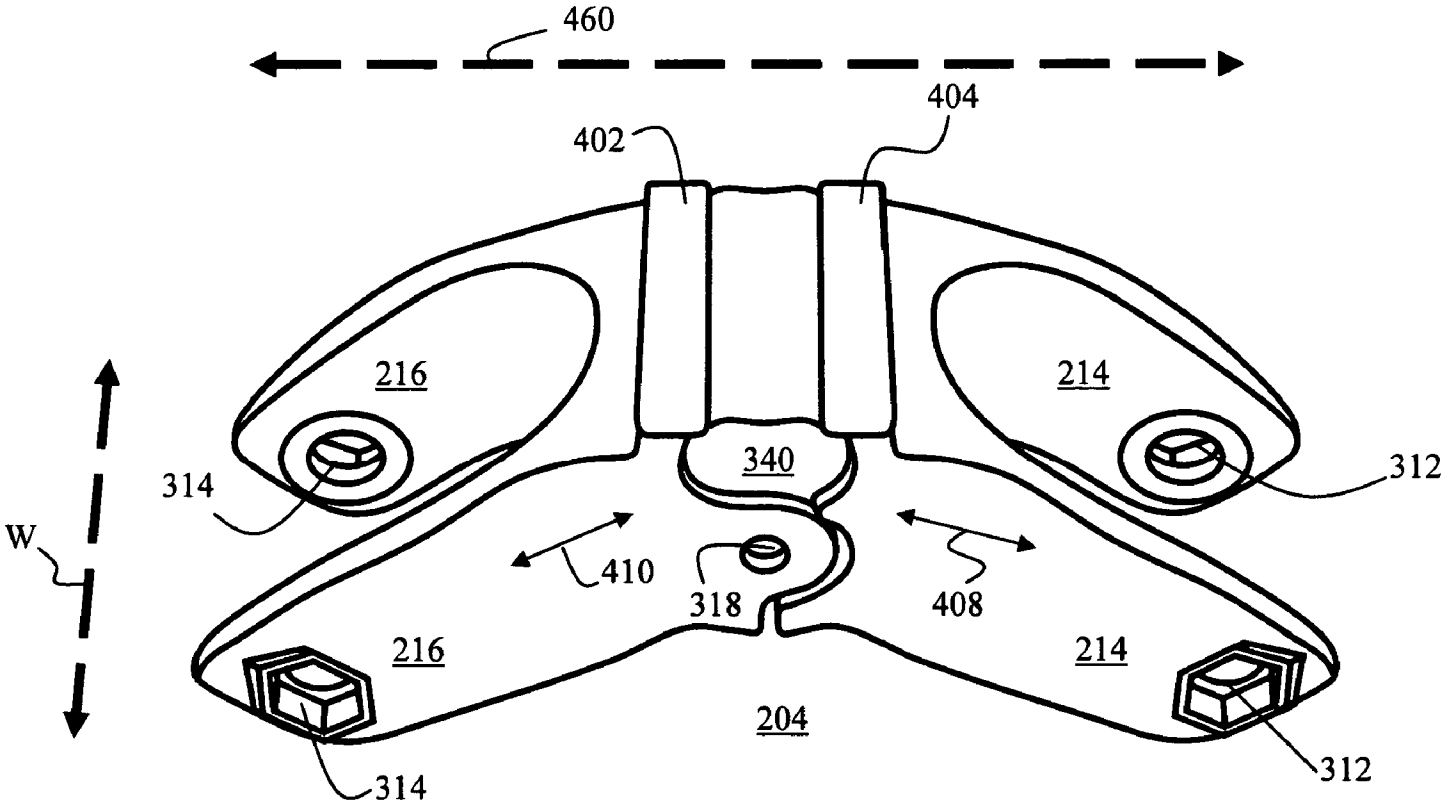
FIG. 4B is an exemplary lateral top perspective illustration of the suspension mechanism of FIG. 4A.
Figure 4C:
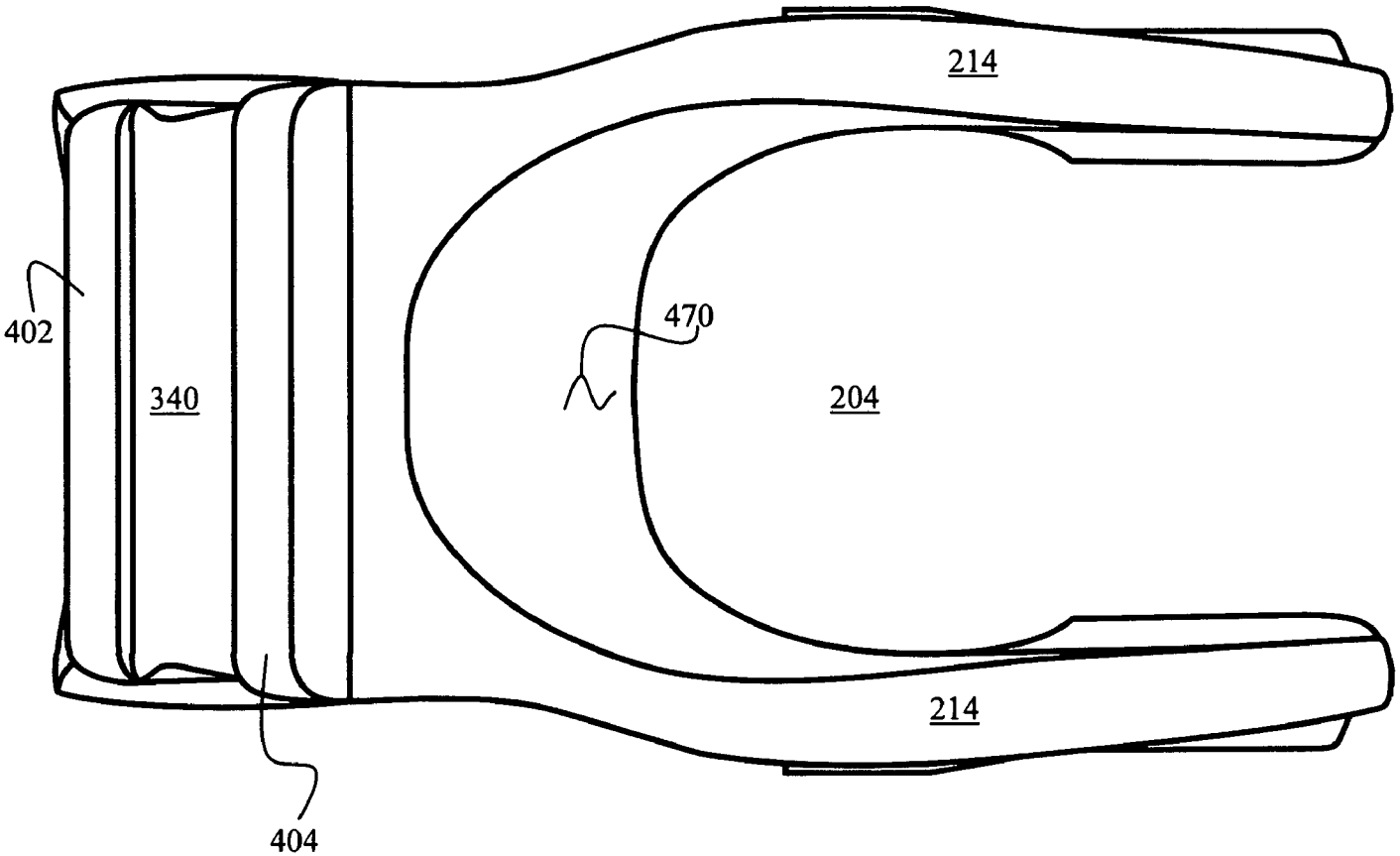
FIG. 4C is an exemplary bottom-axial perspective view of the suspension mechanism of FIG. 4A.
Figure 4D:
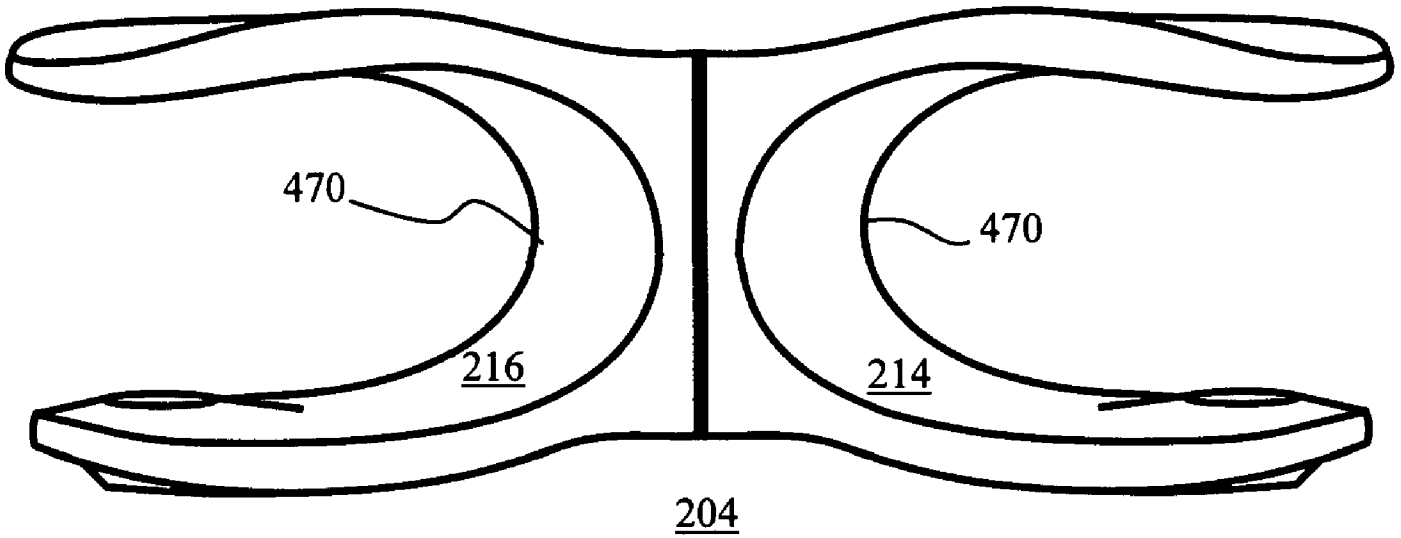
FIG. 4D is an exemplary bottom perspective view of the suspension mechanism of FIG. 4A.

As illustrated in FIGS. 4A and 4B, during the ride of the in-line skate 200, when encountering an uneven surface, the wheels 206 coupled at the distal ends 460 and 462 of the respective rocker arms 214 and 216 move along the substantially vertical reciprocating path 450, pushing the respective proximal ends 464 and 466 along the substantially horizontal reciprocating path 452 (along the axial length 460 of the suspension mechanism 204). Stated otherwise, top sections 402 and 404 of the respective rocker arms 216 and 214 will move in the direction of the reciprocating path 452, pressing against the biasing mechanism 340, while the distal ends 460 and 462 move along the vertical reciprocating path 450. The combined rocker arms 214 and 216 move pivotally along the reciprocating paths 408 and 410, pivoting along the pivot axis 310. As illustrated, in response to the applied compression by the rocker arms 214 and 216, the biasing mechanism 340 is deformed in the direction indicated by the vertical arrow referenced 414, which provides a spring action for the wheels. As best illustrated in FIGS. 4C and 4D, the suspension mechanism 204 includes a curved-in section 470 to accommodate a set of wheels 206 so to allow the wheels 206 to rotate without contacting the body of the rocker arms 214 and 216.

Figure 4E:
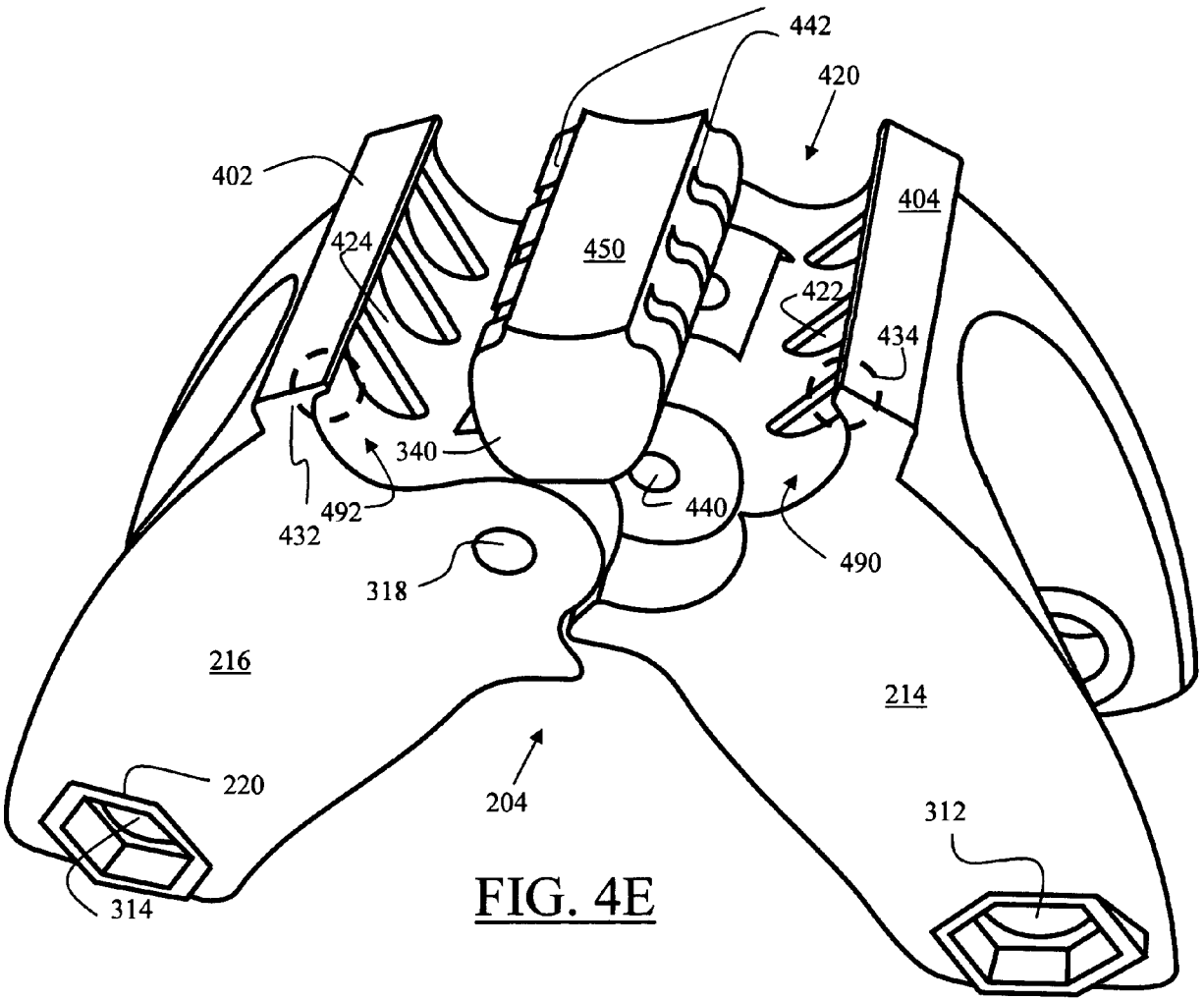
FIG. 4E is an exemplary perspective view of the suspension mechanism of FIG. 4A, with the rocker arms semi-separated, illustrating a removable biasing mechanism and the housing for a biasing mechanism.
Figure 4F:
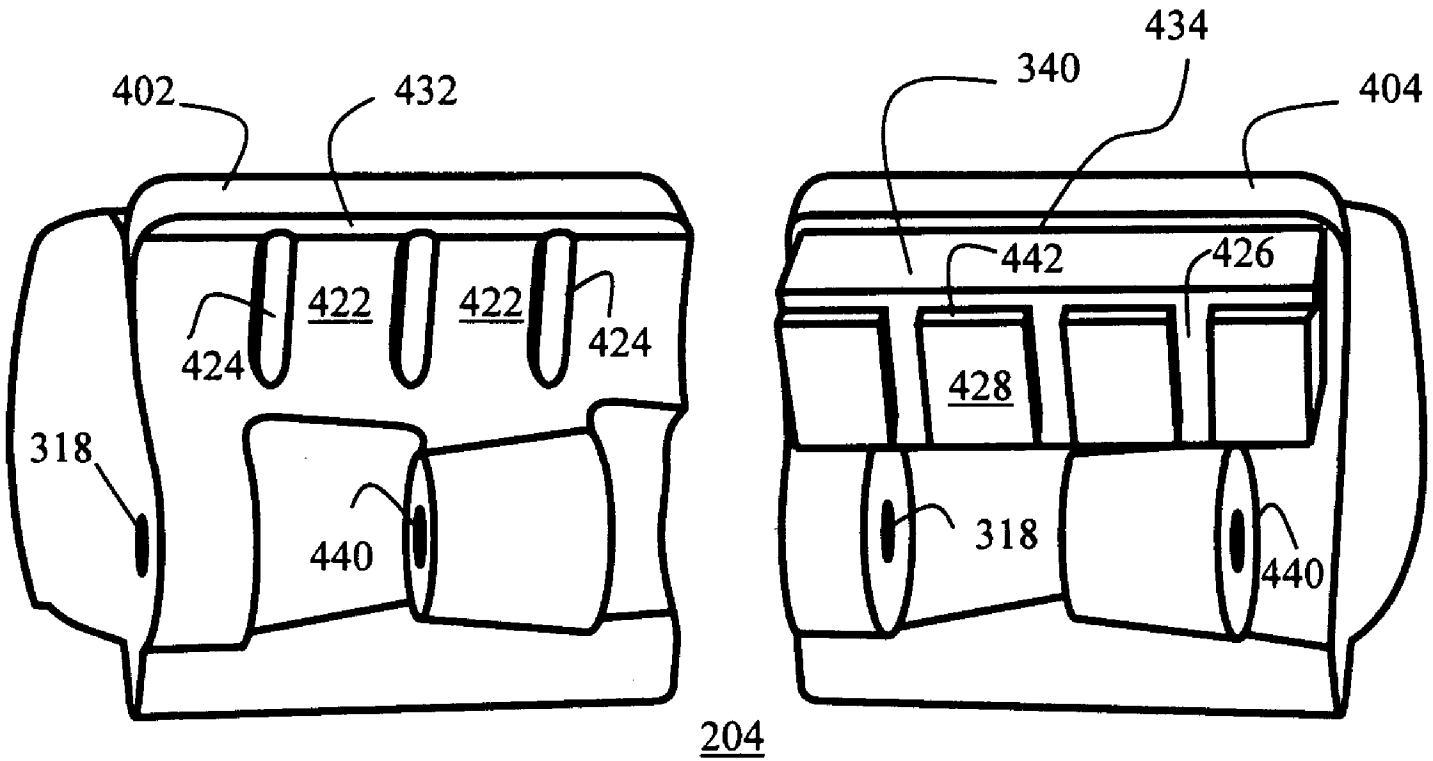
FIG. 4F is an exemplary perspective plan view of the rocker arms and the biasing mechanism detachably coupled therein.
Figure 8A:
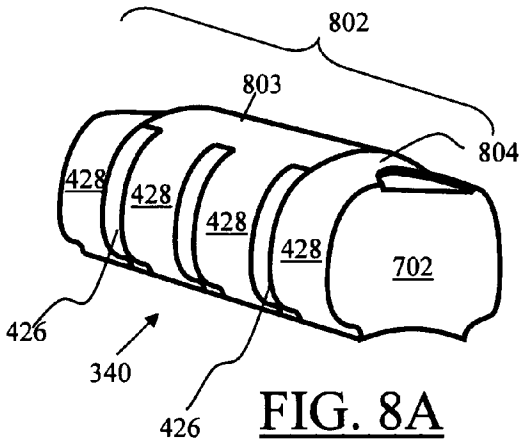
FIGS. 8A to 8D are exemplary illustrations of the biasing mechanism of FIGS. 7A to 7D, illustrating the various bottom views, in accordance with the present invention.
Figure 8B:
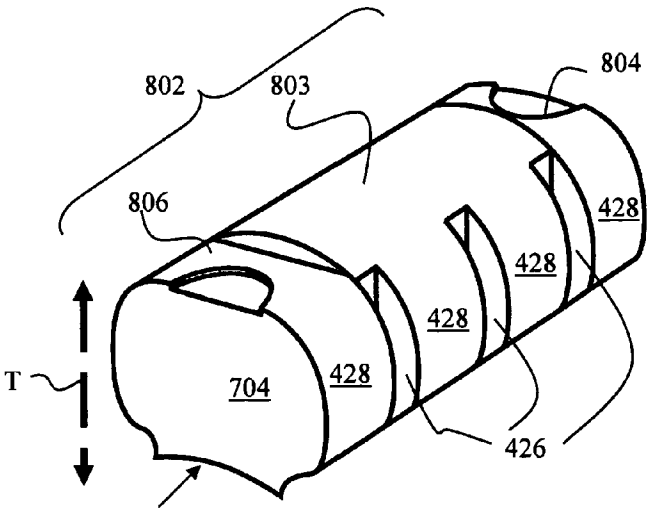
Figure 8C:
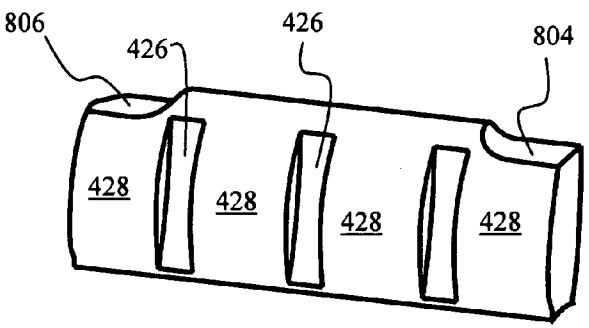
Figure 8D:
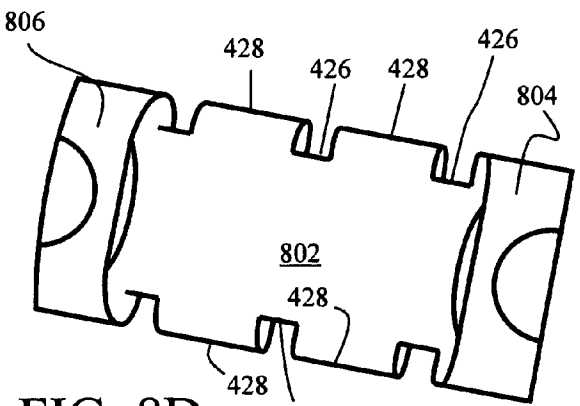

As best illustrated in FIGS. 4E and 4F, the biasing mechanism 340 (in the form of a polyurethane spring) is configured to mate with the biasing mechanism housing 420, forming the suspension mechanism 204 of the present invention. As illustrated, the biasing mechanism 340 includes two lateral side surfaces that include a plurality of vertically oriented notches 426 that are aligned laterally, and abut the plurality of vertically oriented flanges 422 of the biasing mechanism housing 420. A bottom surface 802 (FIG. 8A) of the biasing mechanism 340 abuts the pivoting axle connection. It should be noted that the entire described structure of the biasing mechanism 340 and the biasing mechanism housing 420 can be reversed (upside-down) or inversed. That is, the top of the biasing mechanism 340 can be contained within the biasing mechanism housing 420, and the bottom 802 thereof can abut the top 402 and 404 of the biasing mechanism housing 420. One non-limiting important factor is to contain the biasing mechanism 340, and allow for one free side (longitudinally) of the biasing mechanism 340 for depression and or expansion thereof against pressure or forces from the rocker arms. The biasing mechanism 340 contacts the first rocker arm 214 and the second rocker arm 216 and biases the rocker arms so that the rocker arms counter-rotate about the pivoting axle, against applied forces due to ride on uneven surface areas.

Figure 5A:
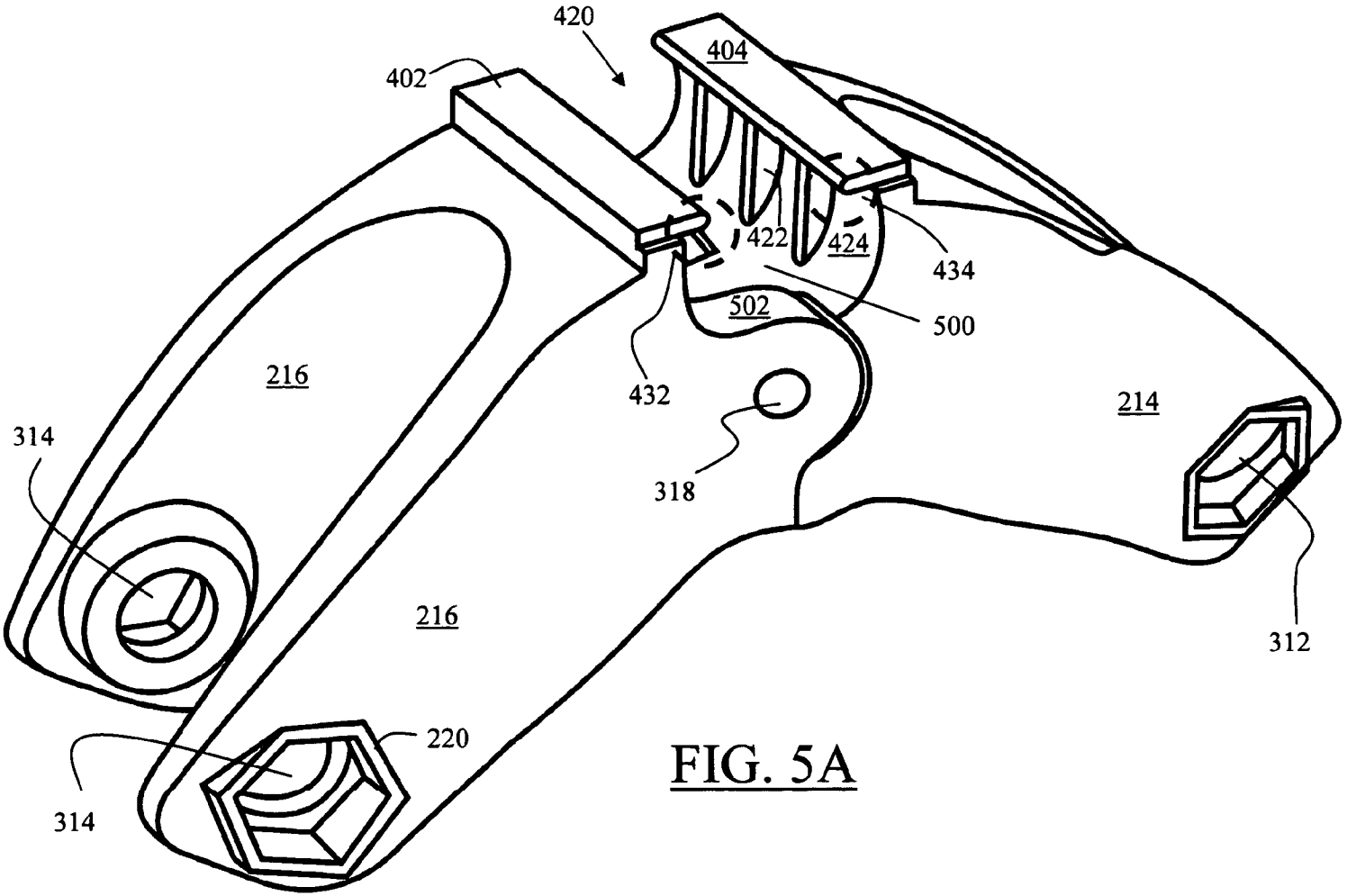
FIG. 5A is an exemplary perspective view of the assembled rocker arms in accordance with the present invention.
Figure 5B:
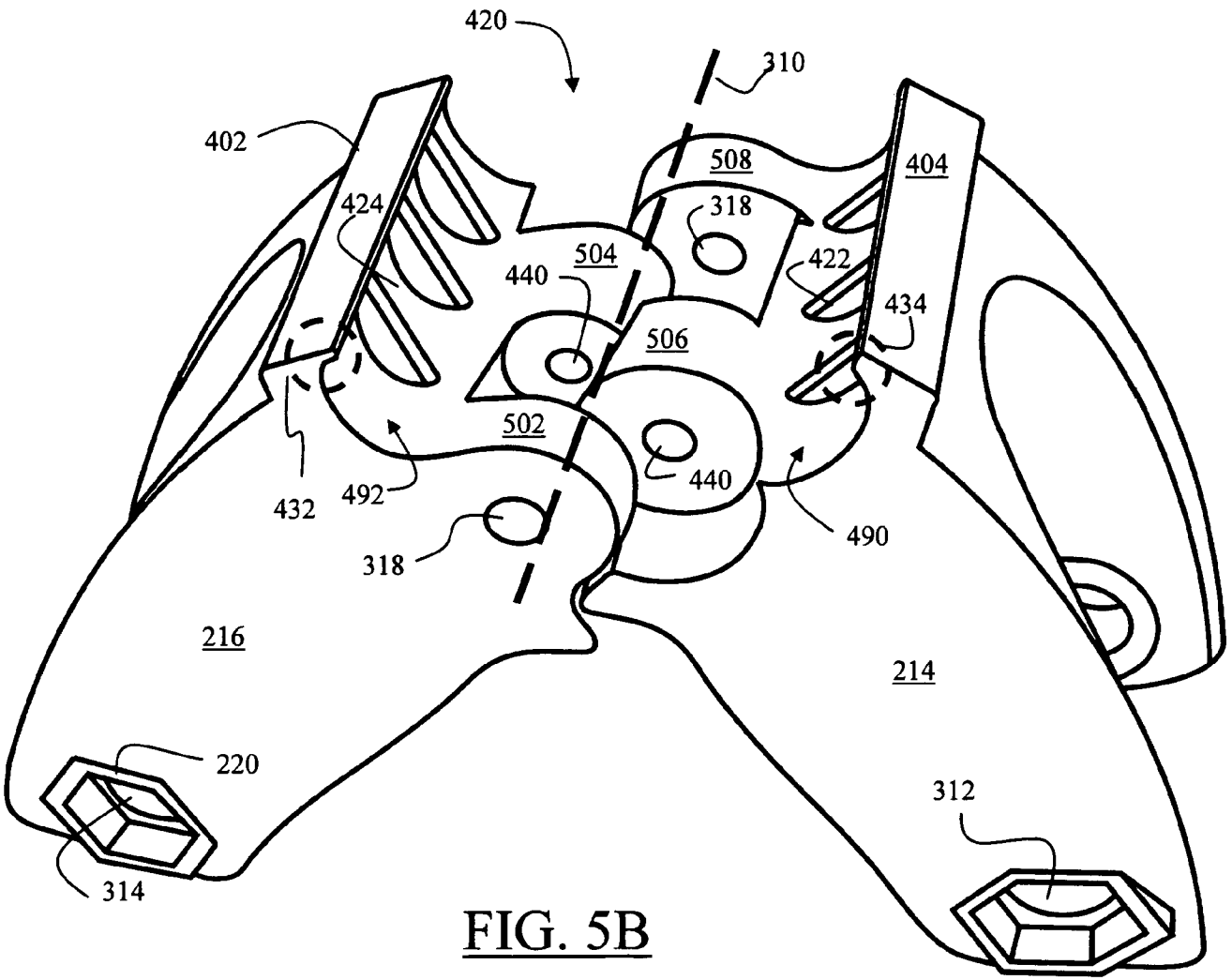
FIG. 5B is an exemplary perspective of semi-assembled rocker arms illustrated in FIG. 5A.
Figure 5C:
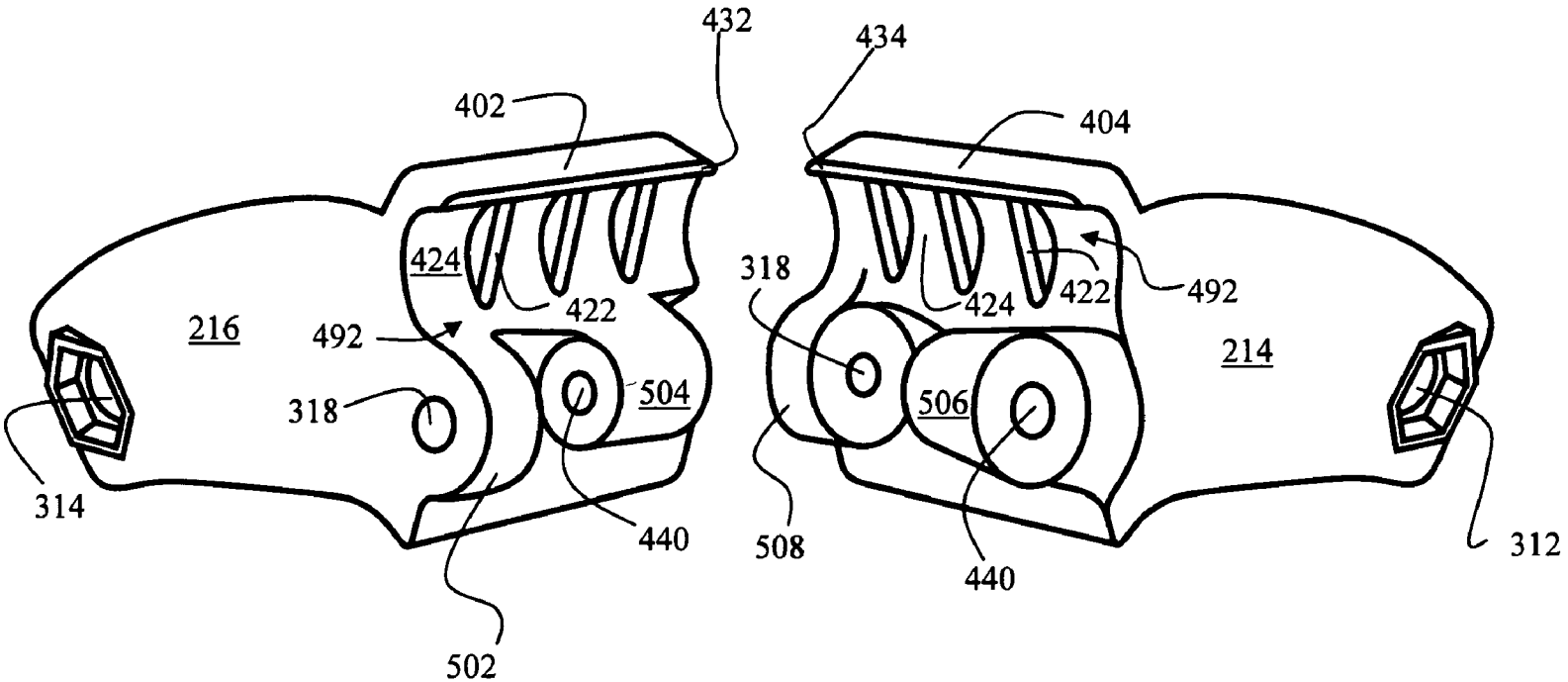
FIG. 5C is a perspective illustration of disassembled rockers illustrated in FIG. 5A.

FIGS. 5A to 5C are exemplary illustrations of the rocker arms, including the biasing mechanism housing in accordance with the present invention. As illustrated in FIGS. 5A to 5C, the rocker arms 214 and 216 are comprised of a set of pivot knuckles 502, 504, 506, and 508 that form the pivoting axis 310 in the form of pivoting axle connections 318 and 440 for each rocker arm, allowing the rocker arms 214 and 216 to pivot about the pivoting axis 310. The respective first and second proximal end 464 and 466 of the respective first and second rocker arms 214 and 216 form the two lateral side walls 490 and 492 of the biasing mechanism housing 420. The vertically oriented lateral side walls 490 and 492 include a plurality of vertically oriented flanges 422 that are aligned laterally along the lateral side walls 490 and 492. The biasing mechanism housing 420 also includes a top 402 and 404 at the first and second proximal end 464 and 466 having a length that extends longitudinally along an axial width W of the set of rocker arms and a width forming a lip 432 and 434. A top surface 450 of the biasing mechanism 340 includes two lateral edge depressions 442 that securely abut the lip 432 and 434 of the biasing mechanism housing 420.

Figure 6:
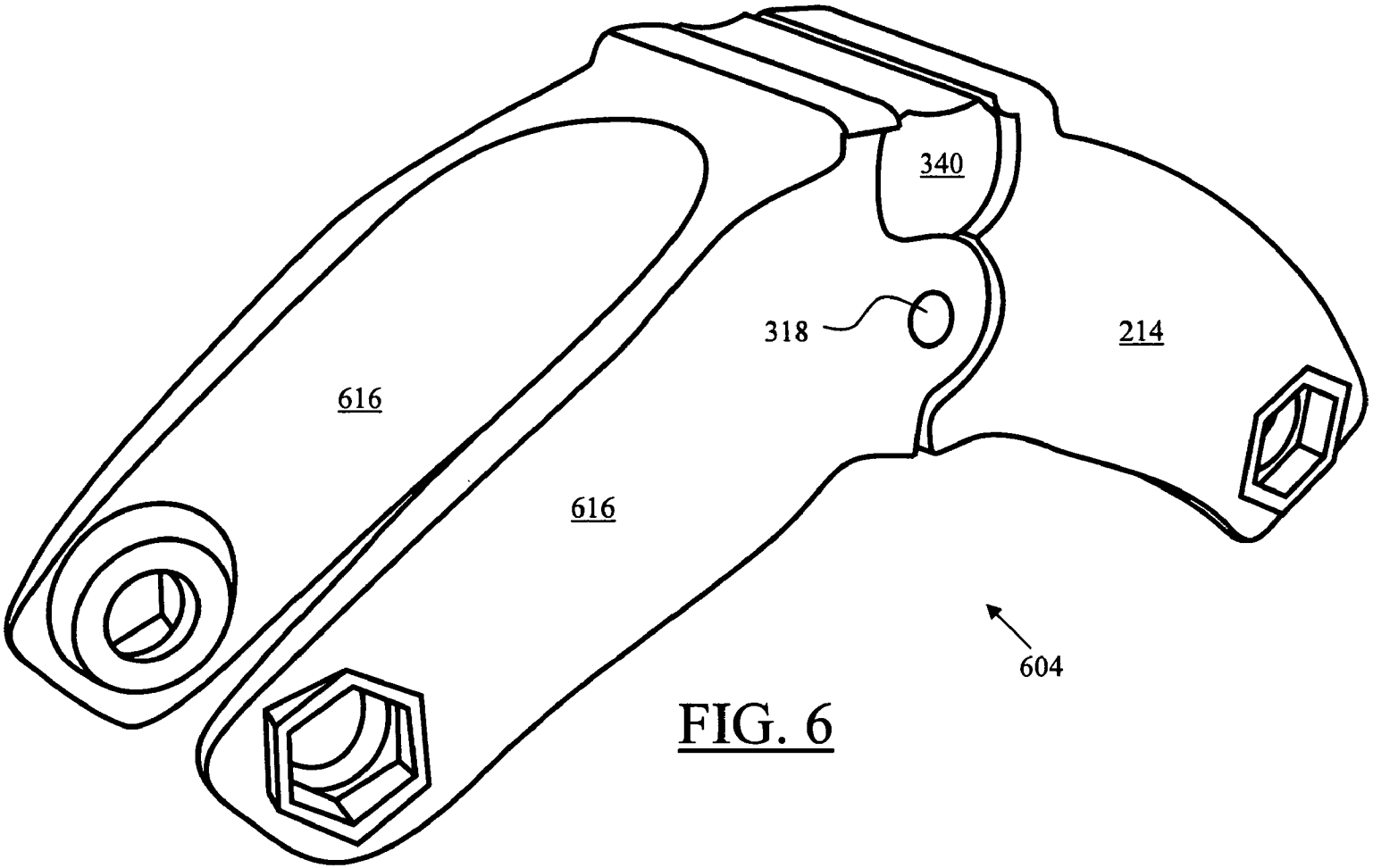
FIG. 6 is an exemplary illustration of a second embodiment of a suspension mechanism in accordance with the present invention.
Figure 7B:
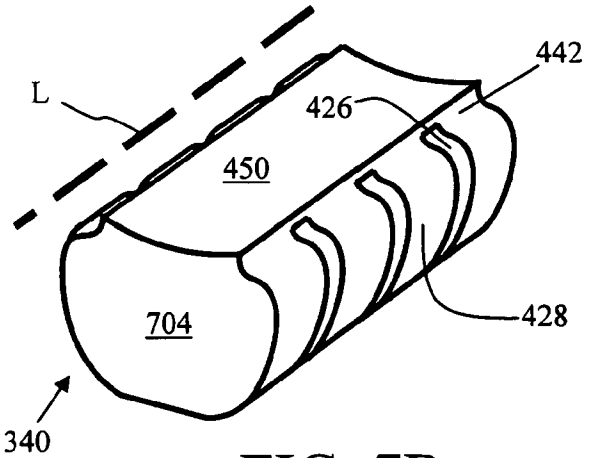
FIGS. 7A to 7D are exemplary illustration of the biasing mechanism, illustrating various top views thereof in accordance with the present invention.
Figure 7D:
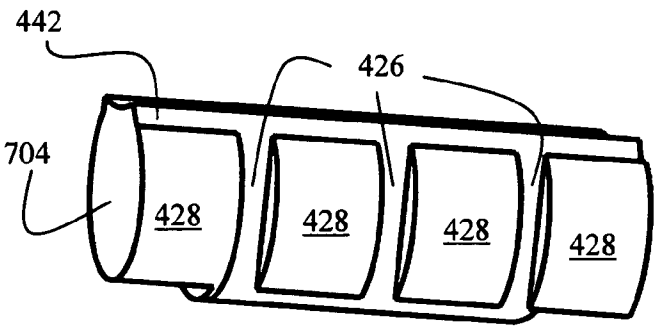
Figure 7A:
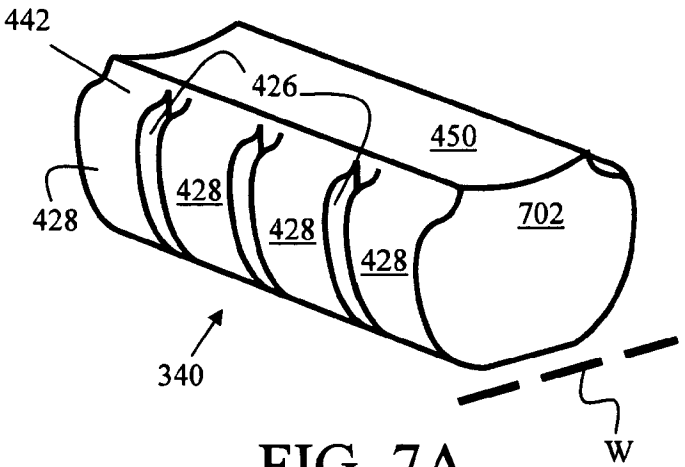
Figure 7C:
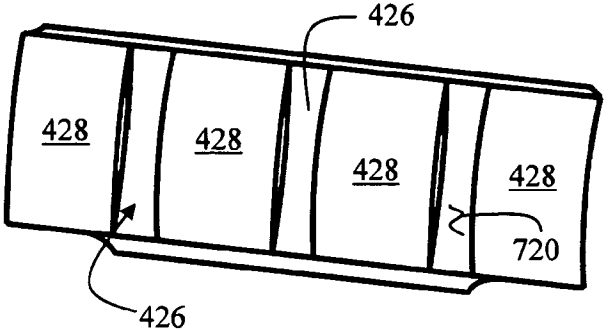

FIG. 6 is an exemplary illustrations of a second embodiment of a suspension mechanism 604 in accordance with the present invention. The suspension mechanism 604 includes similar corresponding or equivalent components as the suspension mechanism 204 that is shown in FIGS. 2A to 5C, and described above. Therefore, for the sake of brevity, clarity, convenience, and to avoid duplication, the general description of FIG. 6 will not repeat every corresponding or equivalent component that has already been described above in relation to the suspension mechanism 204 that is shown in FIGS. 2A to 5C.

As illustrated, the suspension mechanism 604 includes a first rocker arm 214 that is shorter than a second rocker arm 616. In general, it is preferred that the suspension mechanism 604 be coupled with the tracking system 210 in such manner that allows the second, longer rocker arm 616 to be positioned at the distal ends of the tracking system 210. In other words, it is preferred that the first and the last wheels 206 of the in-line skate (at the extremities most distal ends of the tracking system 210) be coupled to the longer rocker arm 616. However, the suspension mechanism 604 may be oriented along the tracking system 210 at any position. This will provide a greater flexibility in the selection of wheel size and wheel placement along the tracking system 210.

FIGS. 7A to 7D are exemplary illustration of the biasing mechanism, illustrating various top views thereof, and FIGS. 8A to 8D are exemplary illustrations of the biasing mechanism of FIGS. 7A to 7D, illustrating various the bottom views, all in accordance with the present invention. As illustrated, the polyurethane biasing mechanism 340 is comprised of a first surface contact area 428 with a first mass having a durometer that provides a first resistance and a first rate of resistance responsive to application of forces. It further includes a second surface contact area 426 with a second mass having the same durometer that provides a second resistance and a second rate of resistance responsive to the forces, with the first resistance and the first rate of resistance different from the second resistance and second rate of resistance, a combination of which provides a rate of resistance that commensurately varies and is correspondingly responsive in relation to varying forces. In other words, a method for varying a resistive response and resistive rate of response of a polyurethane is provided by the present invention by increasing its contact surface area and lowering its mass.

The polyurethane material biasing mechanism 340 has an axial length L, a width W, and a depth (or thickness) T. Its top surface 450 includes slightly concaved section or depression that is extended longitudinally, along the axial length L thereof, with the slightly concaved section including lateral edge depressions 442 extending longitudinally, along the axial length L of the biasing mechanism 340.

As further illustrated, the polyurethane material biasing mechanism 340 further includes two lateral side surfaces with periphery that is curved forming a radial protuberance 428, and extending longitudinally along the axial length L of the basing mechanism 340. The curved forming radial protuberance 428 of the lateral surfaces may be flat or any form, including concaved or convex. The lateral side surfaces further include a plurality of vertically oriented notches 426 that are formed into the curved protuberance 428 of the lateral side surfaces of the biasing mechanism 340. The notches 426 are aligned laterally along the axial length L of the biasing mechanism 340, forming an alternating notch 426 and protuberance 428. Each notch 426 of the plurality of notches is comprised of a substantially flat base 720, with the curved protuberances forming two side walls of each notch 426. The flat base 720 extends from the top surface 450 to a bottom surface 802 of the biasing mechanism 340, and substantially perpendicular to the interior two side walls that form the notch. The biasing mechanism 340 further includes a bottom surface 802 having a respective first and second distal ends 804 and 806 that are substantially flat, and a center portion 803 that is slightly convex extending longitudinally along the axial length L of the basing mechanism 340 between the respective first and second distal ends 804 and 806. It should be noted that the bottom surface 802 can vary in form to match the biasing mechanism housing 420.

As illustrated, the above described structure of the biasing mechanism 340 and the accommodating biasing mechanism housing 420 of the rocker arms 214 and 216 increase the overall contact surface area while reducing the overall mass of the biasing mechanism 340. The structural arrangement provides a wide range of resistance to accommodate a smooth ride against the application of different forces and, more particularly, provides a rate of resistance that commensurately varies and is correspondingly responsive in relation to shifting of user weight during the ride of the in-line skates, without requiring any adjustments. In addition, the structure of the suspension mechanism 204 of the present invention is simple and does not require user meddling for adjustment of resistance and rate of resistance of the biasing mechanism 340.

The overall contact surface area of the biasing mechanism 340 is increased by providing the notches and the curved protrusion along the lateral side walls thereof. The overall mass of the biasing mechanism is decreased by removing material form the lateral side walls to create the notches. The overall increase in contact surface area and decrease in polyurethane mass provides for a biasing mechanism that has a greater overall wider range of resistance against the application of different forces and, more particularly, wider range of rate of resistance that commensurately varies and is correspondingly responsive in relation to shifting of user weights during the ride of the in-line skates.

In particular, the contact point surface area of the base 720 of the notches 426 has an overall less polyurethane mass than at the protuberances of the lateral side walls 428. In general, the smaller the mass of the polyurethane is, the greater its stiffness (higher resistance against deformation under compressive forces). These sections (notches 426, with their base 720) have a greater degree of resistance against an applied pressure or force due to less mass and therefore, require a higher level of compression (forces) to deform. In other words, the contact points (the base 720) respond with different resistance and rate of resistance against an application of force, compared to the protuberances 428 (with higher level of polyurethane mass). The protuberances 428 (with higher polyurethane mass) have a lesser degree of resistance and therefore, would deform quicker against a smaller force (compression). For quicker response rate (of resistance), the base 720 and the interior lateral side walls forming the walls of the notches 426 are preferably formed at a substantially 90 degree angle, providing the least mass with highest level of contact surface area.

The curved protuberance area 428 of the biasing mechanism 340 increases the contact surface area between the biasing mechanism 340 and the rocker arm housing 420, while the notches 426 reduce the overall mass of the biasing mechanism. When compressed by the rocker arms, the top concaved portion 450 of the biasing mechanism 340 becomes convex, and hence, under pressure, the biasing mechanism 340 must first overcome the concaved curve resistance, providing greater resistive characteristics. The concaved configuration further removes more mass from the biasing mechanism 340, lowering its overall mass to increase its stiffness while increasing surface area. In addition, the thin edge 442 mating with the lip 432 and 434 of the rocker arms top 402 and 404, decreases overall mass to increase resistance and further, increases contact area.

Figure 9B:
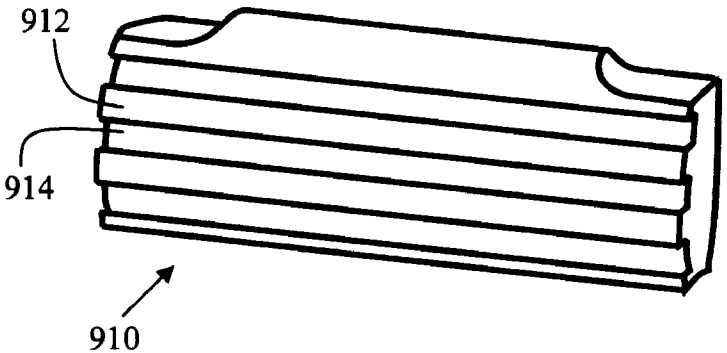
FIGS. 9A to 9C are exemplary illustrations of various other embodiments of a biasing mechanism in accordance with the present invention.
Figure 9C:
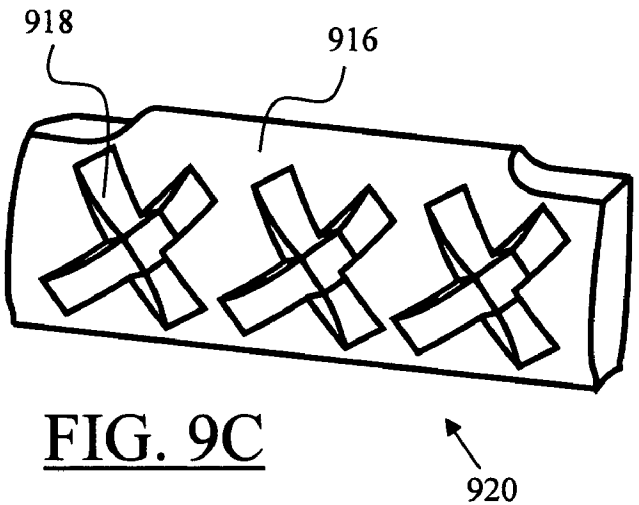
Figure 9A:
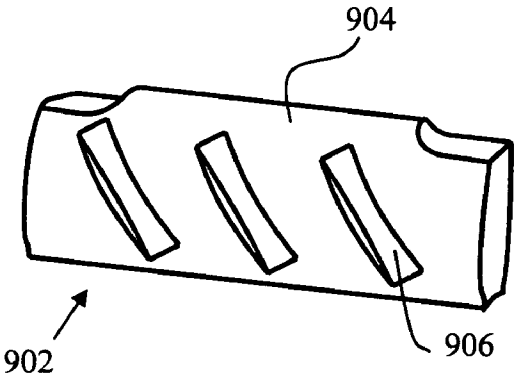

FIGS. 9A to 9C are exemplary illustrations of various other embodiments of a biasing mechanism in accordance with the present invention. The biasing mechanisms 902, 910, and 914 include similar corresponding or equivalent components as the biasing mechanism 340 that is shown in FIGS. 2A to 8D, and described above. Therefore, for the sake of brevity, clarity, convenience, and to avoid duplication, the general description of FIGS. 9A to 9C will not repeat every corresponding or equivalent component that has already been described above in relation to the biasing mechanism 340 that is shown in FIGS. 2A to 8D.

As illustrated, the polyurethane biasing mechanisms 902, 910, and 920 are comprised of a respective first surface contact area 904, 912, and 916 with a first mass having a durometer that provides a first resistance and a first rate of resistance responsive to application of forces. They further include a second surface contact area 906, 914, and 918 with a second mass having the same durometer that provides a second resistance and a second rate of resistance responsive to the forces. As with the biasing mechanism 340, the first resistance and the first rate of resistance for the biasing mechanism 902, 910, and 920 are different from the second resistance and second rate of resistance, a combination of which provides a rate of resistance that commensurately varies and is correspondingly responsive in relation to varying forces. In other words, a method for varying a resistive response and resistive rate of response of a polyurethane is provided by the present invention by increasing its contact surface area and lowering its overall mass, regardless of orientation of notches. Of course, the orientation of the flanges of the biasing mechanism housing of the rocker arms must commensurate with the orientation of the notches on the biasing mechanism so to house and accommodate the biasing mechanisms. In other words, for example, the horizontally oriented set of notches 914 of the biasing mechanism 910 illustrated in FIG. 9B, would require a biasing mechanism housing that has a corresponding set of horizontally oriented flanges. The same may be said for the biasing mechanisms 902 and 920.

Although the invention has been described in considerable detail in language specific to structural features and or method acts, it is to be understood that the invention defined in the appended claims is not necessarily limited to the specific features or acts described. Rather, the specific features and acts are disclosed as preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. For example, the top 402 and 404 with the lip 432 and 434 are optional, it is only used to secure the biasing mechanism 340 that have vertical notches. Biasing mechanisms with notches having horizontal or other orientations do not require a top. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, proximal, distal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A suspension system, comprising:

a first rocker arm having a first skate wheel connection at first distal end;

a second rocker arm having a second skate wheel connection at a second distal end;

a spring housing;

a pivoting axle connection, the pivoting axle connection pivotally connecting the first rocker arm at a first proximal end and the second rocker arm at a second proximal end, and forming a bottom of the spring housing;

the spring housing further including two lateral side walls at the first and second proximal end of the respective first and second rocker arms;

the lateral side walls include a plurality of flanges that are-aligned laterally along the lateral side walls; and a spring comprised of polyurethane, including:

a top surface that includes two lateral edge depressions that securely abut a lip;

two lateral side surfaces that include a plurality of notches that are aligned laterally, and abut the plurality of flanges; and a bottom surface that abuts the pivoting axle connection;

the spring contacting the first rocker arm and the second rocker arm and biasing the rocker arms so that the rocker arms counter-rotate about the pivoting axle.

2. An in-line skate wheel suspension product, the product comprising:

a tracking system that is comprised of:

a base-support comprised of a fore plate and an aft plate coupled with a sole of a boot;

side panels extending downward from the base-support;

the side panels are spaced apart, which enable positioning a skate wheel between the side panels;

a first rocker arm disposed between the side panels;

the first rocker arm having a first skate wheel rotatably connected to the first rocker arm at a first skate wheel connection;

a second rocker arm disposed between the side panels;

the second rocker arm having a second skate wheel rotatably connected to the second rocker arm at a second skate wheel connection;

a pivoting axle, the pivoting axle pivotally connecting the first rocker arm and the second rocker arm to at least one of the tracking system side panels;

a spring, the spring positioned above the pivoting axle;

the spring positioned between the first rocker arm and the second rocker arm;

the spring having a plurality of notches, positioned laterally along an axial length of the spring, with each notch biased against a corresponding protrusion on the rocker arms;

the spring contacting the first rocker arm and the second rocker arm and biasing the rocker arms so that the rocker arms counter-rotate about the pivoting axle;

the spring contacting the first rocker arm at a position radially between the pivoting axle and the first skate wheel connection; and the spring contacting the second rocker arm at a position radially between the pivoting axle and the second skate wheel connection.

* * * * *